US008839781B2

(12) United States Patent
Vazquez Garcia et al.

(10) Patent No.: US 8,839,781 B2
(45) Date of Patent: Sep. 23, 2014

(54) OVEN DOOR

(75) Inventors: Jose Merced Vazquez Garcia, Santiago de Queretaro (MX); Ulises Hernandez Orduña, Santiago de Queretaro (MX); Gustavo Aguillon De Jesus, Santiago de Queretaro (MX); Guillermo Rocha Aguilera, Santiago de Queretaro (MX)

(73) Assignee: Mabe, S.A. de C.V., Queretaro (MX)

( * ) Notice: Subject to any disclaimer, the term of this patent is extended or adjusted under 35 U.S.C. 154(b) by 437 days.

(21) Appl. No.: 13/205,896

(22) Filed: Aug. 9, 2011

(65) Prior Publication Data

US 2012/0216789 A1 Aug. 30, 2012

(30) Foreign Application Priority Data

Feb. 28, 2011 (MX) ..... MX/a/2011/002230

(51) Int. Cl.
*F23M 7/02* (2006.01)
*F24C 15/04* (2006.01)

(52) U.S. Cl.
CPC ..... *F24C 15/04* (2013.01)
USPC ..... 126/190; 126/198; 126/200; 126/273 R

(58) Field of Classification Search
USPC ..... 126/190, 198, 200, 273 R
See application file for complete search history.

(56) References Cited

U.S. PATENT DOCUMENTS 2,630,605 A * 3/1953 Hobson et al. ..... 52/291
3,228,388 A * 1/1966 Mills ..... 126/200
3,362,396 A 1/1968 Bohdan (Continued)

FOREIGN PATENT DOCUMENTS

BE 1001370 A * 10/1989
CN 1891055 1/2007

(Continued)

*Primary Examiner* — Jorge Pereiro
(74) *Attorney, Agent, or Firm* — Beusse Wolter Sanks & Maire, P.A.

(57) ABSTRACT

A panoramic oven door which has a counter door structure which comprises a first outer section of counter door in the shape of a substantially rectangular structural frame, which has a support groove surrounding its inner perimeter border; a second inner section of counter door in the shape of a substantially rectangular structural frame, which has a coupling flange surrounding its outer perimeter border; wherein said first and second sections of counter door are coupled between each other by means of a plurality of coinciding supports or brackets formed over the same and joined by means of fastening elements; in such a way that said coupling flange of the second inner section of the counter door is made to coincide within the support groove formed in the first outer section of the counter door; and wherein additionally, an isolating thermal seal made of fiber glass thread woven in the shape of a flat hose is interposed between said coupling flange and said support groove once coupled, to avoid direct contact between both sections of the counter door creating a thermal breaking between them; said isolating thermal seal also has a seam performed in close proximity to one of its borders and parallel along the entire length of the same, thus forming a small tubular section along the length of the border of the seal within which an additional cylindrical fiber glass seal of smaller diameter woven in a braid shape is introduced, resulting in a lateral re-border which acts as an obstruction and cushioning element for the support of the ceramic glass panel over the counter door avoiding direct contact with the same.

22 Claims, 47 Drawing Sheets

(56) References Cited

U.S. PATENT DOCUMENTS

| | | | | | |
|---|---|---|---|---|---|
| 3,507,266 | A | * | 4/1970 | Vonasch | 126/190 |
| 3,507,267 | A | * | 4/1970 | Lafforgue | 126/200 |
| 3,578,764 | A | * | 5/1971 | Nunnally et al. | 87/6 |
| 3,710,776 | A | | 1/1973 | Frick | |
| 3,731,035 | A | * | 5/1973 | Jarvis et al. | 219/740 |
| 3,736,916 | A | | 6/1973 | White | |
| 3,828,763 | A | * | 8/1974 | Wilson | 126/200 |
| 3,846,608 | A | * | 11/1974 | Valles | 219/741 |
| 3,855,994 | A | * | 12/1974 | Evans et al. | 126/198 |
| 3,889,099 | A | | 6/1975 | Nuss | |
| 3,939,817 | A | | 2/1976 | Nuss | |
| 4,048,978 | A | * | 9/1977 | Plumat et al. | 126/200 |
| 4,081,647 | A | * | 3/1978 | Torrey | 219/741 |
| 4,512,331 | A | * | 4/1985 | Levi | 126/190 |
| 4,989,381 | A | * | 2/1991 | De Block et al. | 52/204.51 |
| 5,095,657 | A | * | 3/1992 | Marsh | 49/492.1 |
| 5,205,075 | A | * | 4/1993 | Moyer | 49/493.1 |
| 5,289,658 | A | * | 3/1994 | Lusen et al. | 49/492.1 |
| 5,341,601 | A | * | 8/1994 | Moyer | 49/493.1 |
| 5,624,760 | A | * | 4/1997 | Collins et al. | 428/426 |
| 5,644,881 | A | * | 7/1997 | Neilly | 52/455 |
| 5,789,724 | A | * | 8/1998 | Lerssen et al. | 219/741 |
| 5,881,710 | A | * | 3/1999 | Davis et al. | 126/194 |
| 6,591,829 | B1 | * | 7/2003 | Simon | 126/19 R |
| 2004/0107955 | A1 | * | 6/2004 | Schnell et al. | 126/273 R |
| 2006/0027230 | A1 | | 2/2006 | Jung | |
| 2007/0240701 | A9 | * | 10/2007 | Schnell et al. | 126/273 R |
| 2007/0271847 | A1 | | 11/2007 | Chin | |
| 2009/0255524 | A1 | | 10/2009 | Venezia et al. | |
| 2009/0255918 | A1 | | 10/2009 | Venezia et al. | |
| 2012/0031389 | A1 | * | 2/2012 | McMaster et al. | 126/200 |

FOREIGN PATENT DOCUMENTS

| | | |
|---|---|---|
| EP | 1022517 | 7/2000 |
| EP | 1265039 | 12/2002 |
| WO | 2006021935 | 3/2006 |

* cited by examiner

OVEN DOOR

RELATED APPLICATIONS

This application claims priority from Mexican Application Serial No. MX/a/2011-002230 filed Feb. 28, 2011, which is incorporated herein by reference in its entirety.

FIELD OF INVENTION

The present invention relates to a door for a stove's oven of the type which comprises an inner or back panel which is entirely made of panoramic ceramic glass. More specifically it relates to a panoramic oven door which has a counter door structure divided into two parts and with an isolating thermal seal interposed between the same to generate a thermal breaking.

BACKGROUND

Normally doors for a stove's oven are directly subjected on their inner parts to very high temperatures for long lengths of time, so that the heat generated can be easily transmitted to the outer part of the same or to the handle itself, thus resulting in grave danger to the user. Given the latter, several attempts have been made to try to isolate as best possible the inner part of said doors in relation to the outer part to avoid burning the user; however, this has resulted in considerably increasing the robustness of the same given the numerous layers and the large quantity of isolating material which is placed on the inner part, implying that the designs result in poor aesthetic quality, heavy, with higher costs, etc. Currently, attempts to reduce said undesirable robustness of said doors have been made, however, the state of the art has failed in finding a method to effectively isolate heat in the same, through which the safety of the user is guaranteed and additionally an attractive design is attained.

For example, U.S. Pat. No. 5,881,710 divulges a common design for a stove's oven which has a front glass panel, a counter door structure to retain an isolating layer, a package of windows and an inner metallic panel with an opening for window. As a person skilled in the art can appreciate, given that there is not a thermal breaking between the assembly of the different parts conforming the door, it is necessary that this has a considerable robustness given the width of the isolating layer to attain its objective of avoiding to the highest degree possible heat transmission from the inner part to the outer part of the door; thus resulting in a product that is neither aesthetic nor practical.

Furthermore, European publication No. 1 265 039 A2 exposes an oven door with quick assembled which comprises solely three glass panels fastened at a determined separation between each other by means of a peripheral metallic structure, without any type of thermal isolating means between said panels other than the air present there; through which a thin door for an oven is attained, which is both light and aesthetic. However, being that it deals solely with a structure formed by three crystal layers without an inner structure, without thermal isolation, much less an element of thermal breaking between them, it is not possible to achieve adequate temperature isolation of the inner panel regarding the outer part, resulting in a dangerous situation for the user, especially when dealing with a pyrolytic or self-cleaning oven where the temperature can reach temperatures near 500° C.; in addition to also attaining a structure which would be considerably fragile.

On the other hand, U.S. Pat. No. 3,736,916 exposes a structure for a self cleaning oven door which has a sealing strip for thermal breaking between the inner panel and the counter door structure. However, the panels which form the oven door are made of a metallic laminate thus allowing for a greater heat transfer and a more robust and less aesthetic design. Additionally, it is necessary to use an insulator with a great density, which results in an increase in said door's dimensions, and the thermal seal is exposed and in direct contact with the oven's walls, which can detract from the effectiveness through the use and deterioration of the same.

In the same way, several types of oven door construction exist; however, none of these allows having both an aesthetic design with inner and outer panoramic glass panels, light, with low robustness, and which additionally allows a counter door structure with an isolating seal for thermal breaking through which a high degree of heat isolation between the inner panel and the outer panel of the door is achieved.

BRIEF DESCRIPTION OF THE INVENTION

The present invention is an efficient solution to the problems previously mentioned in the background. The present invention relates to the door for the oven of a stove of the type which comprises of an inner or back panel which is made completely of a panoramic ceramic glass. More specifically, it relates to a panoramic oven door which has a counter door structure divided into two parts and with an isolating thermal seal interposed between the same to generate a thermal breaking. Said oven door is mainly conformed by a structure of an outer or front panel, a counter door structure and an inner or back panel.

In the first place, the structure of the outer or front panel is built by at least one upper decorative appliqué and at least one lower decorative appliqué fastened on its back part by a support frame formed by a molding with an upper back support, a molding with lower fastening and lateral posts joined by fastening means. Said support frame is also responsible for supporting a panoramic glass pane between the same and the upper and lower appliqués, in such a way that from a front part view of the outer panel structure only the panoramic glass and the appliqués which can be made of non-oxidizing steel for example, or any other type of material with the preferred appearance, can be seen. At the same time, on the front part of the same structure of the outer panel, a handle is coupled by some type of fastening means which cross over the upper appliqué until a pair of fastening brackets coupled to the molding of the upper back support for its support.

On the other hand, the structure of the counter door comprises a first outer section having the shape of a substantially rectangular structural frame which has a support groove surrounding its inner perimeter border; a second inner section with a counter door in the shape of a substantially rectangular structural frame which has a coupling flange surrounding its outer perimeter border; said first and second sections of the counter door are coupled between themselves by means of a plurality of coinciding fastening brackets or supports which are formed over the same, and joined by fastening means in such a way that said coupling flange is made to coincide with the second inner counter door section within the support groove formed in the first outer section of the counter door. Similarly, an isolating thermal seal manufactured of fiberglass thread in the shape of a flat hose is placed interposed between said coupling flange and said support groove once they are coupled securely, in order to avoid direct contact between both sections of the counter door creating a thermal breaking between them; said thermal seal additionally has a seam found close to one of its borders and which is substantially parallel along the length of the same, forming a small tubular section along the length of the border of the seal, within which, a small additional cylindrical seal is introduced made of fiberglass having a smaller diameter and woven in the shape of a braid which serves as an obstruction element for the same seal and at the same time as cushioning and isolating for the inner or back ceramic glass panel which, once the door is assembled, rests on the counter door, thus avoiding in this way, direct contact with the same. Additionally, a pair of hinges are coupled by fastening means to the sides of the first outer section of the counter door in order to be able to assemble in a hinged manner said oven door unto a cavity of a stove's oven.

Lastly, the inner or back panel comprises a ceramic glass which is coupled unto the structure of the counter door by means of an upper catch and a lower catch, preferably in an "L" shape, fastened to said counter door by means of fastening elements. Both on the upper border as well as on the lower border of the inner panel of the panoramic ceramic glass, a silicon seal is placed which is preferably in a "U" shape, which prevents said ceramic glass from coming into direct contact with any metallic part either from the counter door or said upper and lower ratchets, thus avoiding to the maximum extent possible any heat transfer by conduction means between the same.

In this manner, the structure of the outer or front panels is assembled unto the structure of the counter door by means of fastening elements such as screws, rivets, bolts, soldering joints or any other type of adequate means known in the previous art. The fastening means are set solely on the first outer section of the counter door, being coupled to the fastening brackets of the upper back support molding structure and generally, to the support frame of the front panel structure, thus avoiding the possibility of any direct contact between the inner second section of the counter door and the outer or front panel structure, thus maximally avoiding through this heat transfer by means of conduction between both, given that said second inner section of the counter door, through its location and geometry, is the part which indirectly receives the largest portion of the heat emanating from the oven's cavity. Because of this is that given the isolating thermal seal placed between the first outer section of the counter door and the second inner section of the counter door a thermal breaking between both is caused, avoiding to a large degree the heat transfer absorbed by said second inner section of the counter door towards said first outer section of the counter door, and at the same time towards the structure of the outer or front panel of the door. In addition to the above, between said structure of the outer panel and said structure of the assembled counter door, there remains a space through which the air can circulate from the at least one first opening formed on the lower part of the structure of the outer or front panel (through both the lower appliqué as well as the fastening lower molding), through the at least second opening formed on the upper part of the structure of the outer or front panel (through both the upper appliqué as well as the upper back molding), with the purpose of helping to lower the temperature of the door when the oven is in functioning mode. Within said space between both structures a package of windows is placed formed by two sheets of tinned glass which are mounted substantially parallel on a metallic frame set around the same to fasten them and maintain them at a certain predetermined separation; said frame is joined to a second inner section of the counter door by means of fastening brackets and fastening means in such a way that the windows package is centrally placed on the inner perimeter border of the second inner section of the counter door in the shape of a substantially rectangular structural frame. Additionally, surrounding said windows package, the pieces of thermal isolating material are placed supported by an inner guard such as a metal sheet frame, which in turn is fastened unto the counter door structure by means of fastening elements itself.

In a complementary manner, the inner or back panel of the ceramic glass is assembled to the counter door structure by means of an upper ratchet and a lower ratchet preferably in an "L" shape, fastened to said counter door by means of fastening elements, such as those described previously. It is worth highlighting that between the lower part of the structure of the counter door and the ceramic glass panel, a supplementary thermal seal is found in a longitudinal direction made of fiberglass thread in tubular shape with a steel core, through which a greater separation is accomplished and as such, a better thermal isolation between both parts is attained, in addition to also providing better cushioning from the impacts and vibrations which could arise. Additionally, a lower decorative ratchet can be placed over the lower ratchet preferably in an "L" shape coupled to the structure of the counter door by means of fastening elements with the end purpose of granting better aesthetics to the inner panel by hiding the lower border of the ceramic glass and said lower ratchet being preferably in an "L" shape.

In this manner, according to what was previously described, the construction of the stove's oven door of the present invention is attained, which provides an efficient solution to the problems present in the current state of the art.

Other aspects and advantages of the present invention shall become apparent when the description is referenced in conjunction with the following drawings.

BRIEF DESCRIPTION OF THE DRAWINGS

The particular characteristics and advantages of the invention, as well as other aspects of the invention, shall become apparent from the following description, when taken in conjunction with the accompanying drawings, in which.

DETAILED DESCRIPTION OF THE INVENTION

Definitions

Fastening Elements—A means for fastening different parts. The fastening means can be selected among others from the following group: screws, rivets, bolts, soldering joints, adhesives or any other type of adequate means known in the previous art or which may become disclosed.

Decorative Appliqué—A decorative piece mainly used for ornamental purposes on the door. It can be designed to have any type of shape and made of any preferred material.

Figure 29:
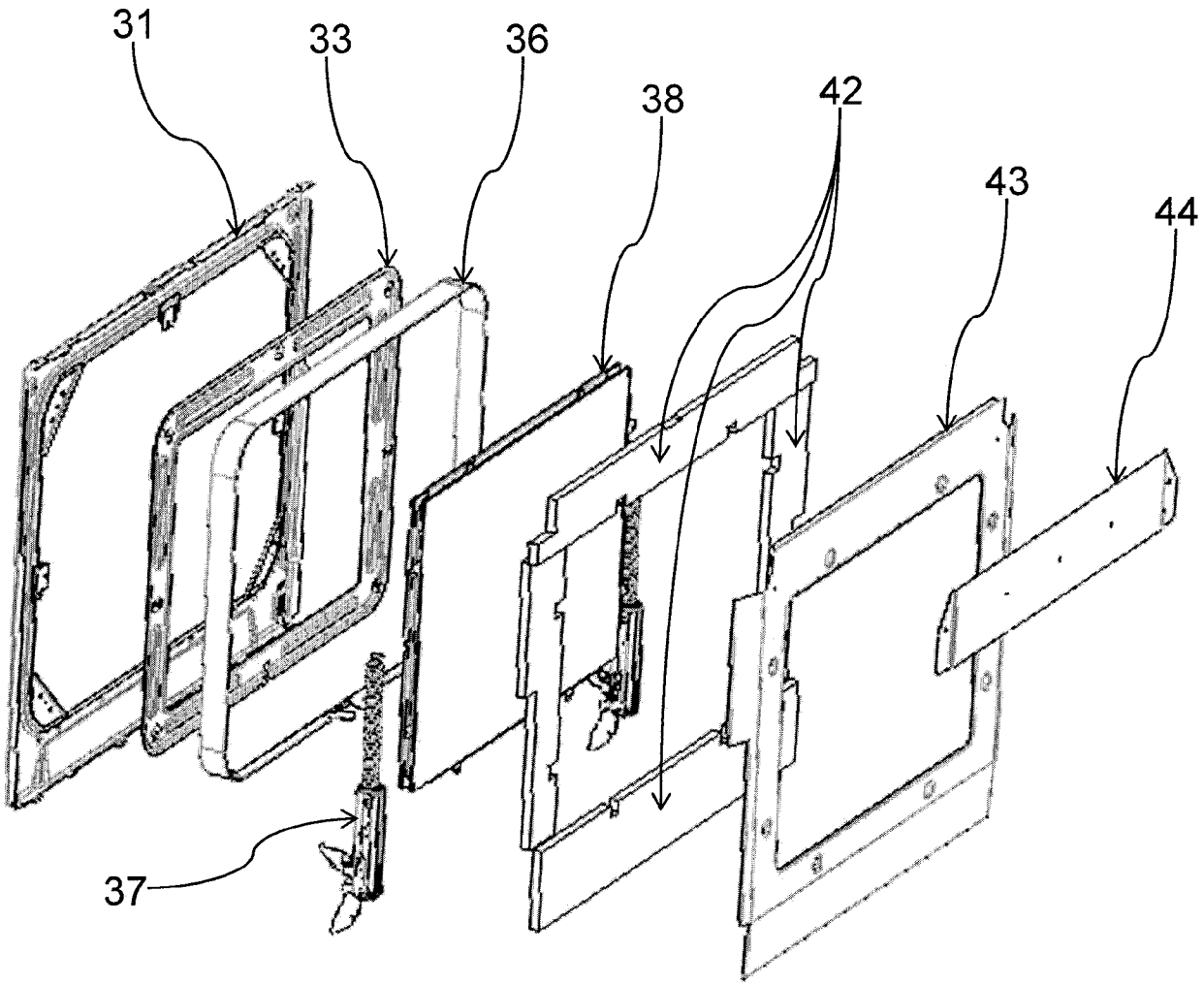
FIG. 29 is an exploded view of the assembly of the counter door structure of the oven door object of the present invention.
Figure 30:
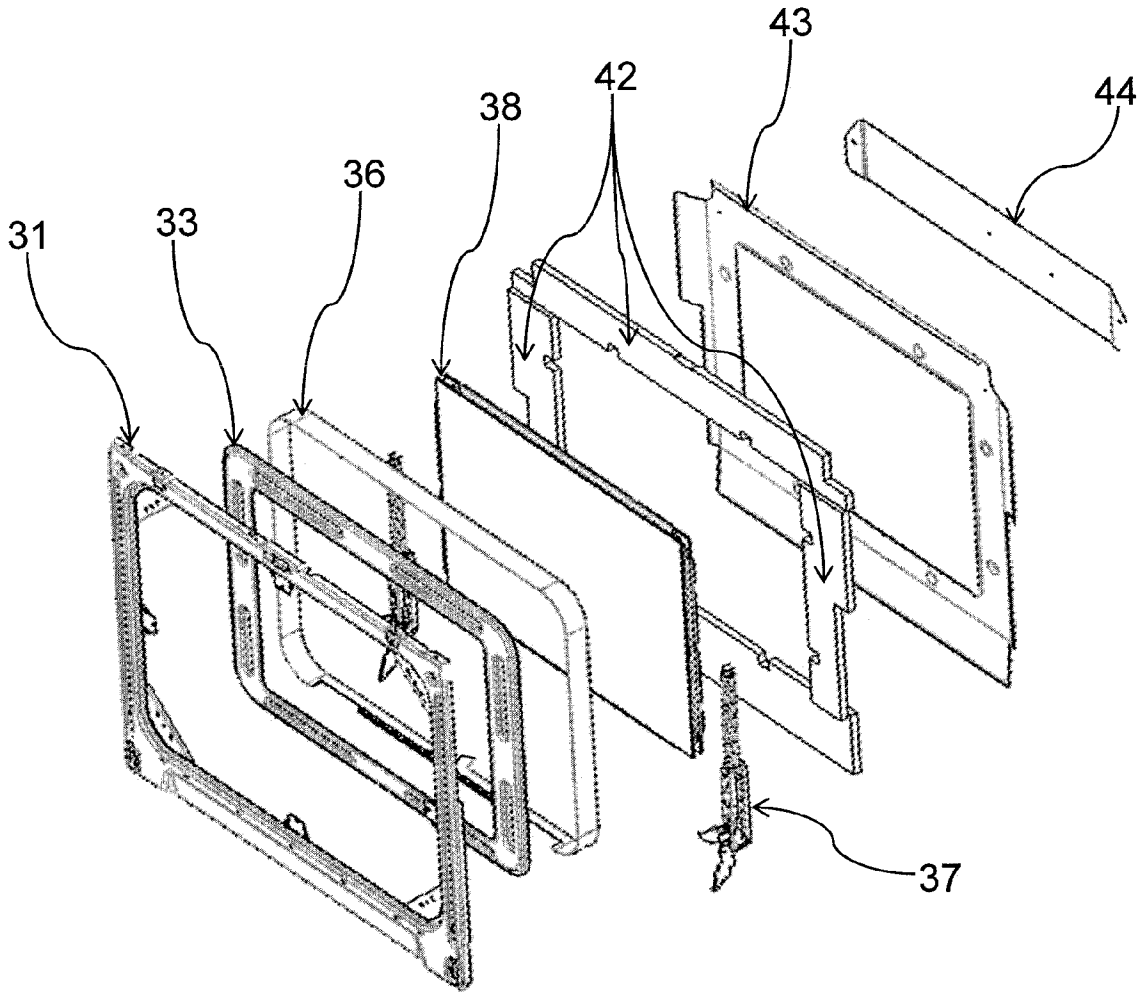
FIG. 30 is a back sided perspective view of FIG. 29.
Figure 31:
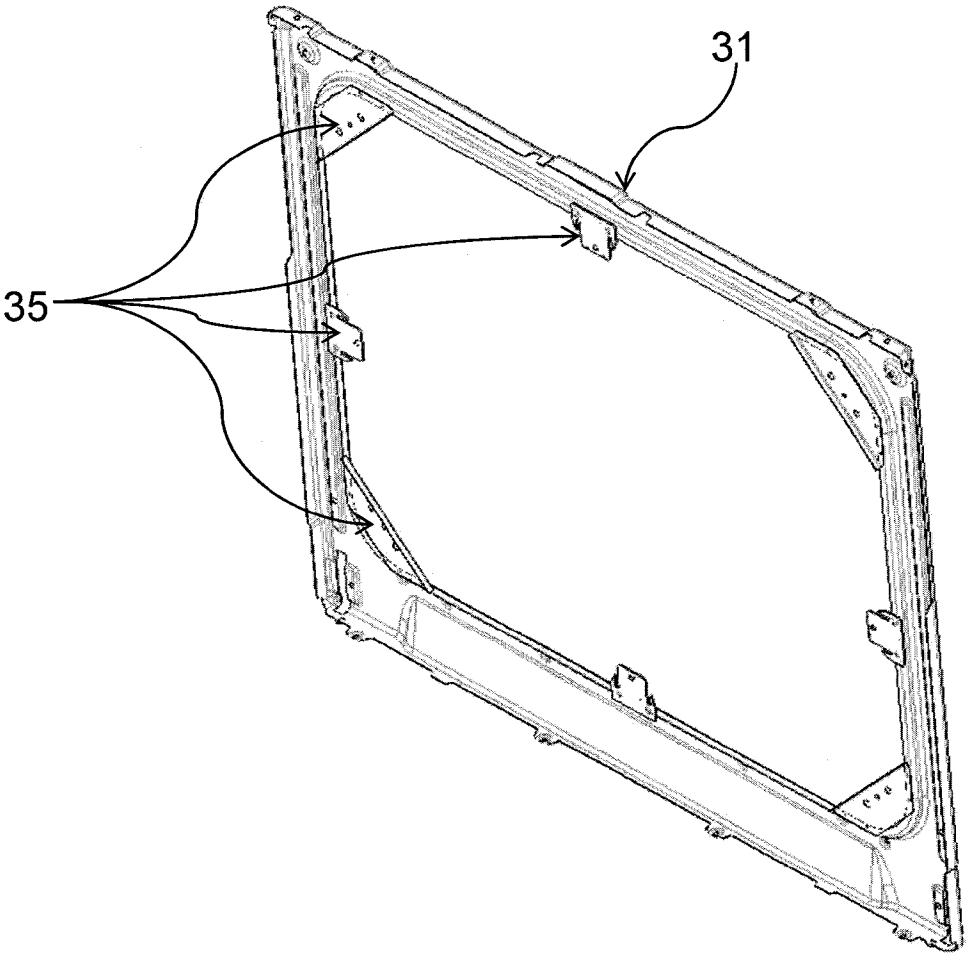
FIG. 31 is a conventional perspective view of the first outer section of the counter door of the counter door structure.
Figure 32:
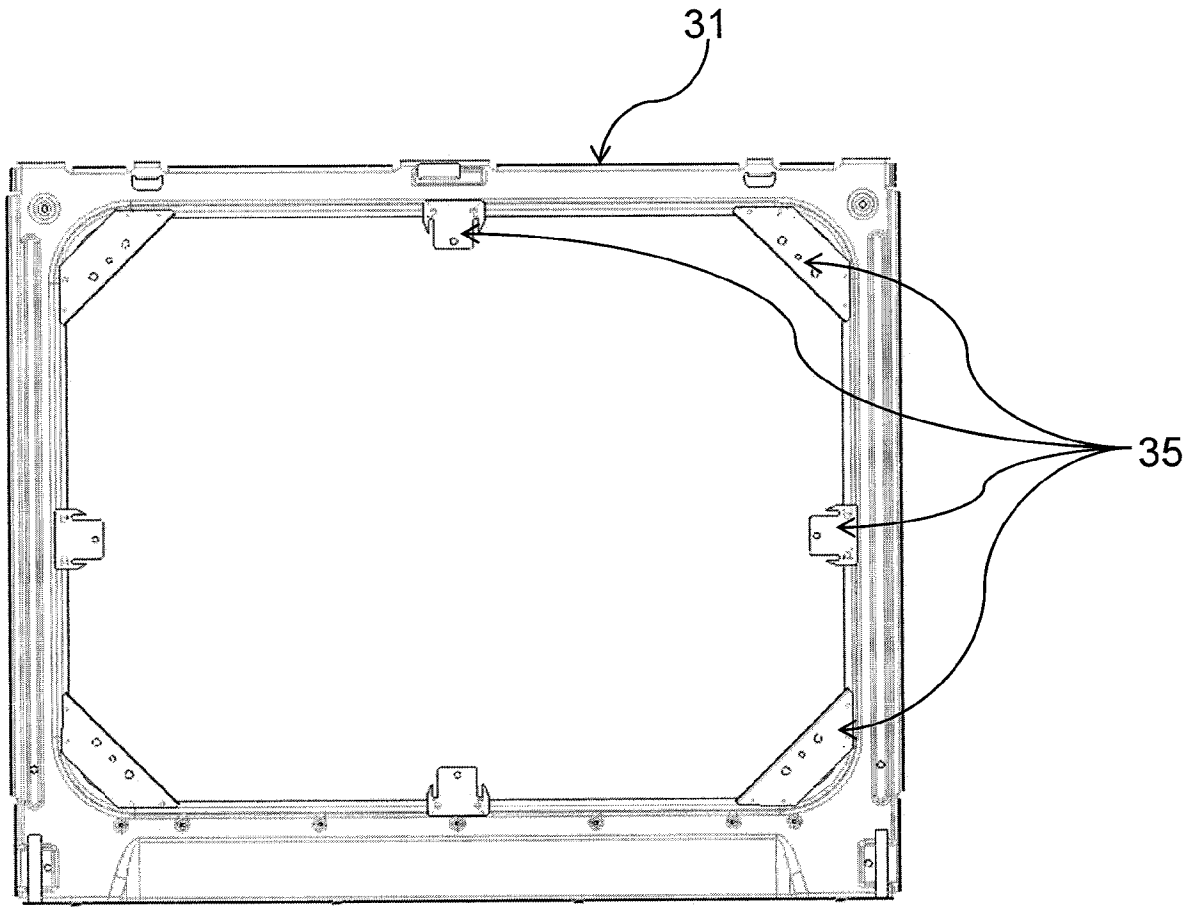
FIG. 32 is a front view of the first outer section of the counter door in FIG. 31.
Figure 33:
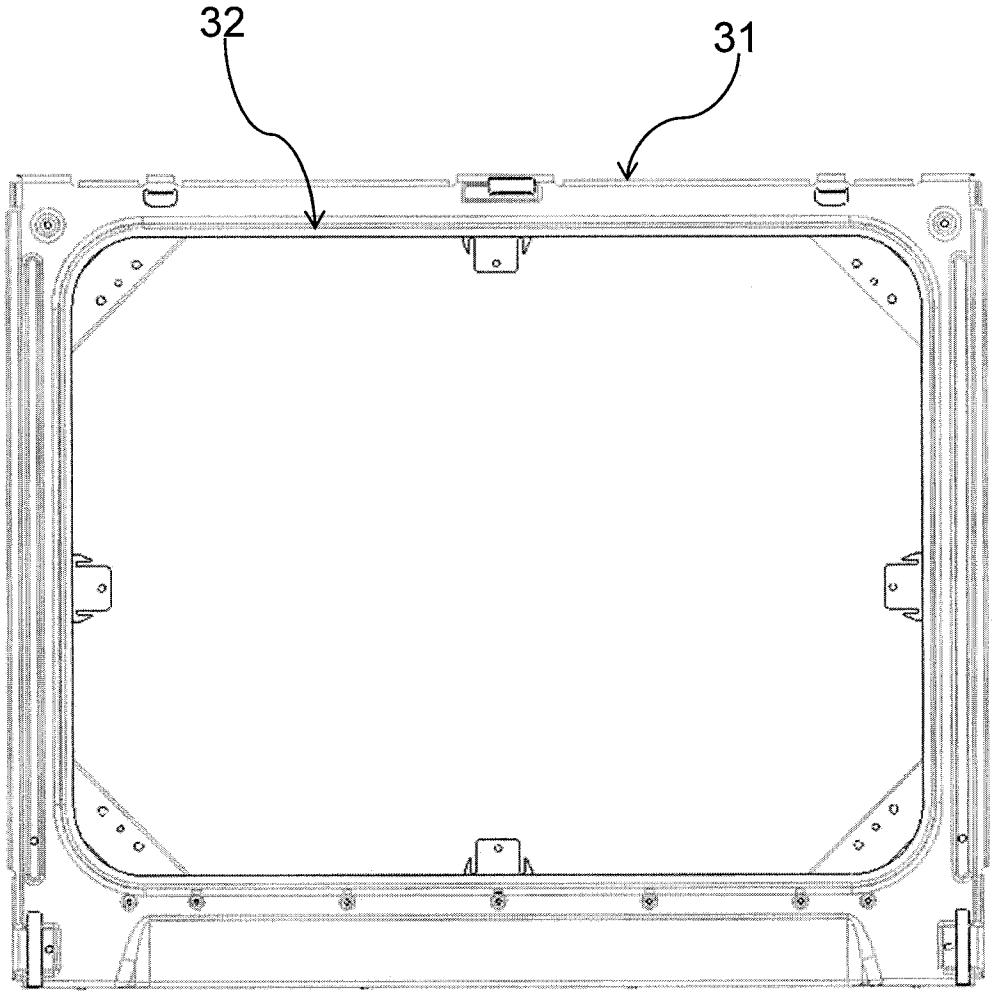
FIG. 33 is a back sided view of the first outer section of the counter door in FIG. 31.
Figure 34:
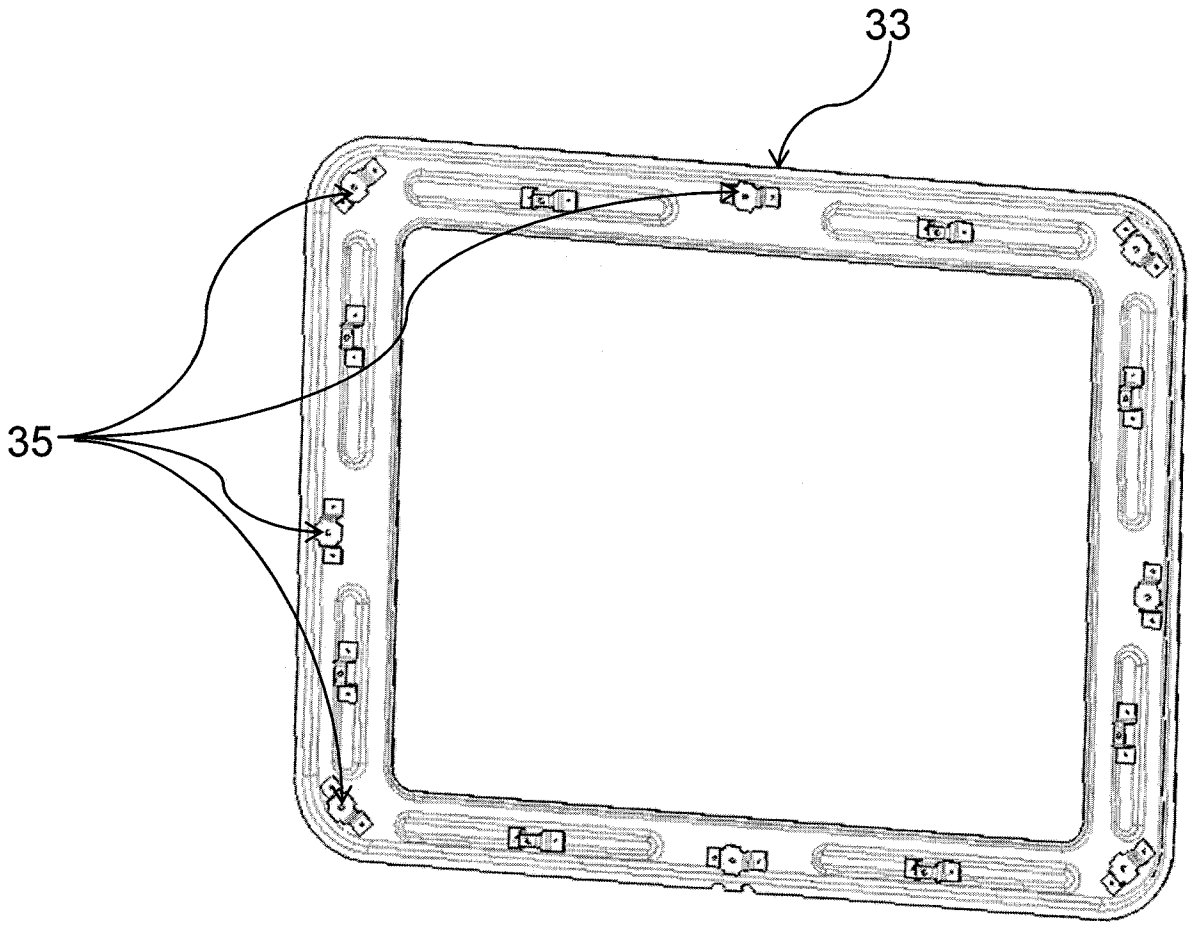
FIG. 34 is a conventional perspective view of the second inner section of counter door of the counter door structure.
Figure 35:
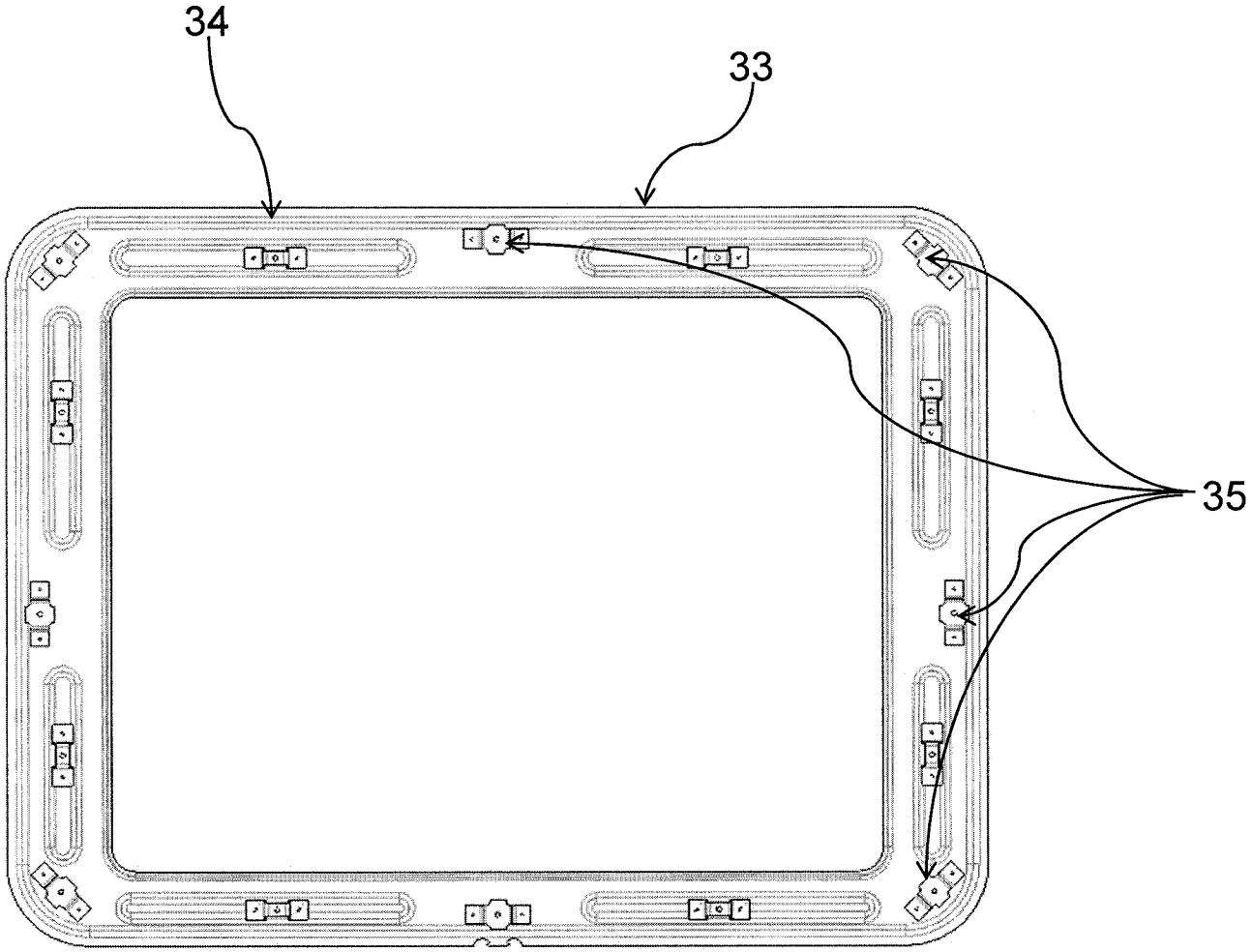
FIG. 35 is a front view of the second inner section of the counter door structure seen in FIG. 34.
Figure 36:
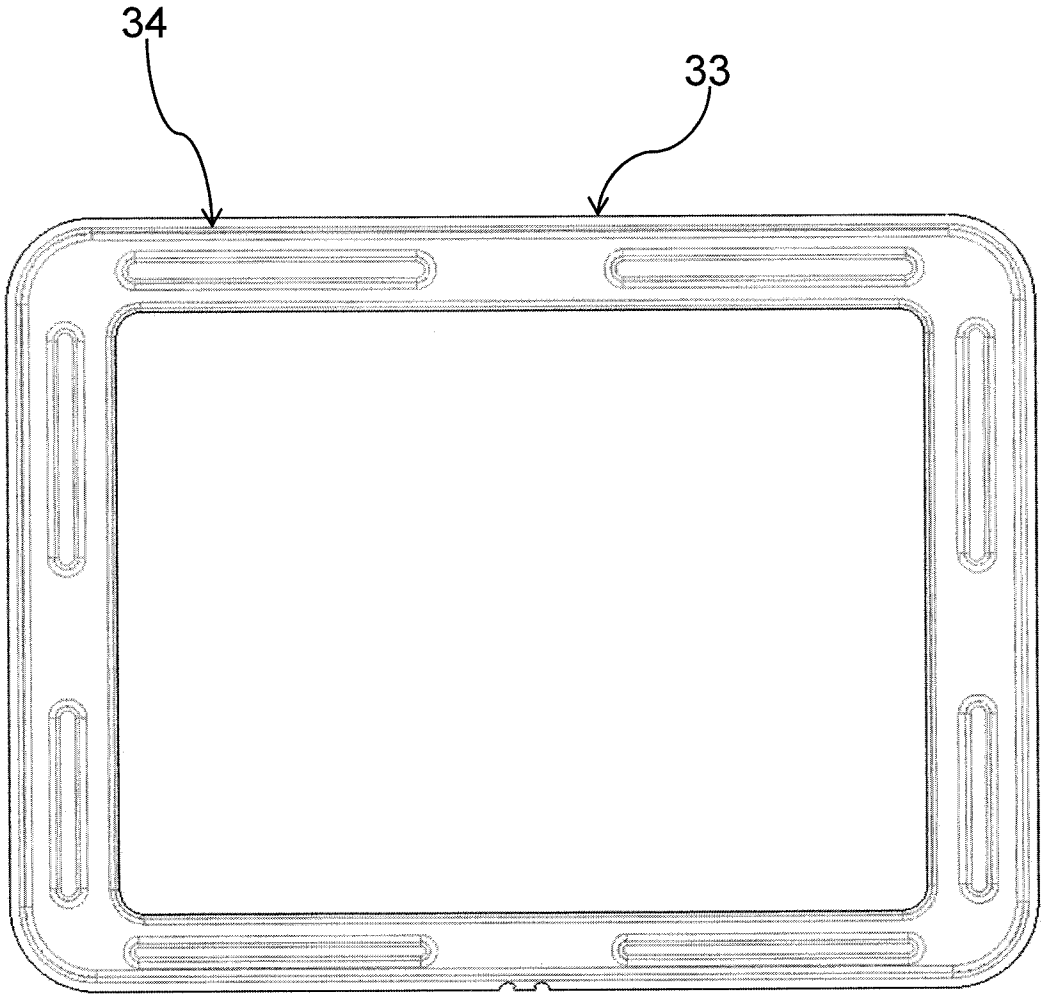
FIG. 36 is a back sided view of the second inner section of the counter door seen in FIG. 34.
Figure 37:
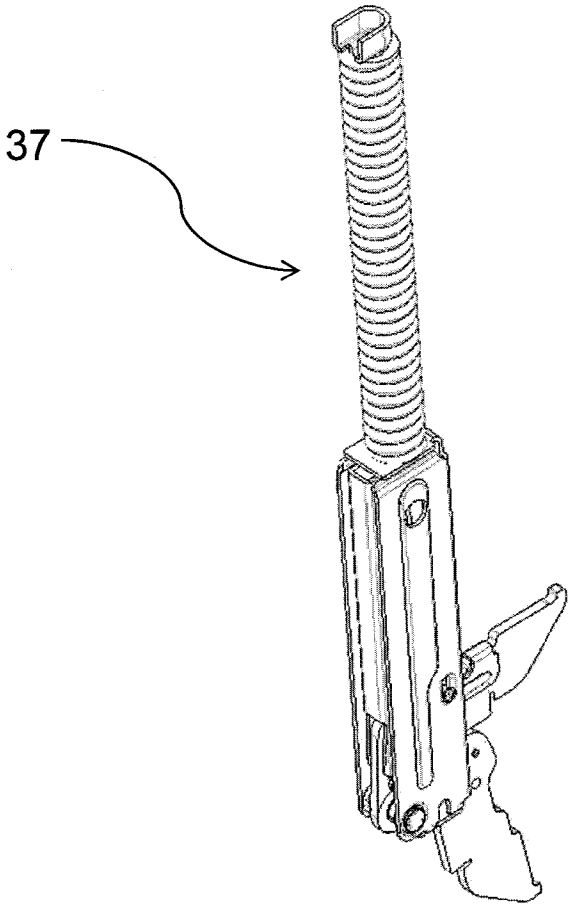
FIG. 37 is a conventional perspective view of one of the hinges coupled to the counter door structure.
Figure 38:
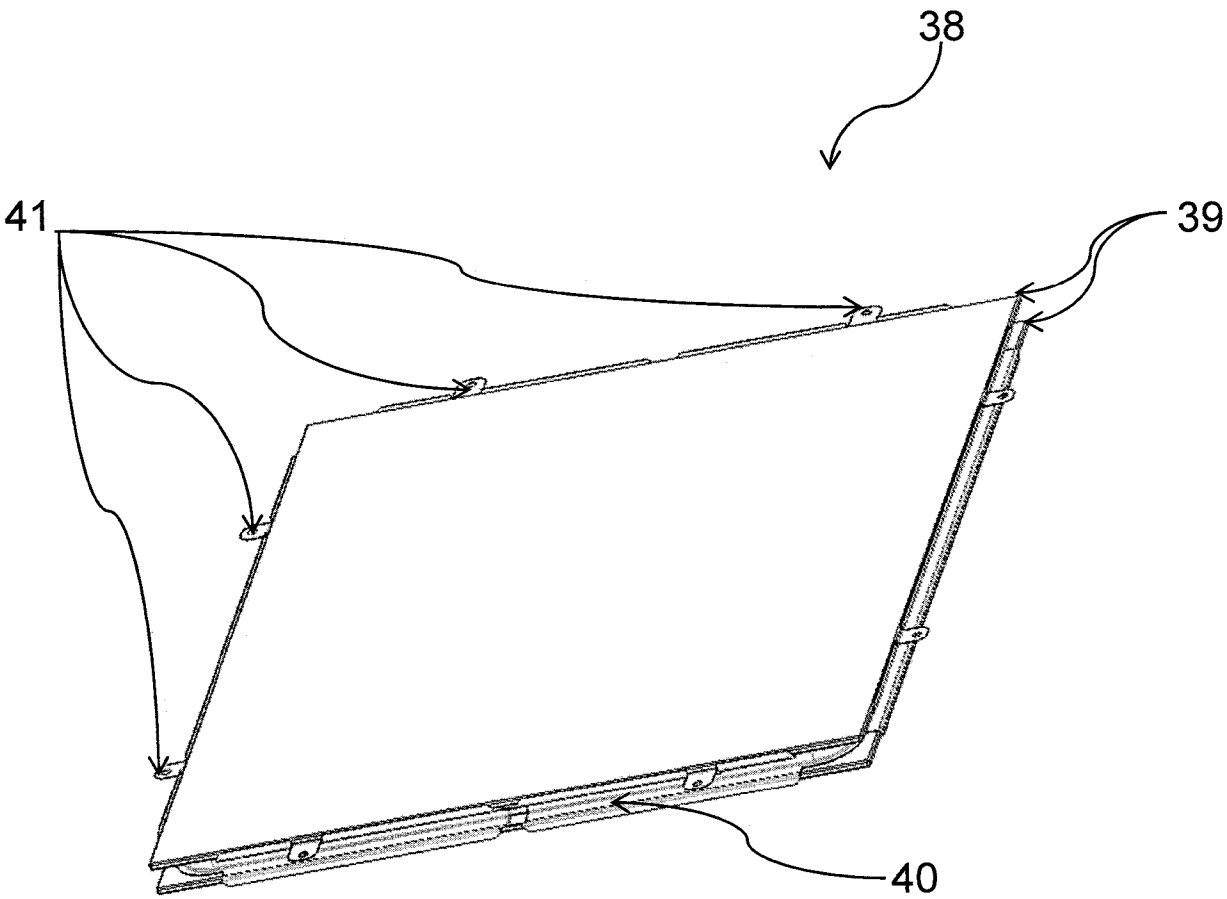
FIG. 38 is a conventional perspective view of the package of windows which are coupled to the second inner section of the counter door.
Figure 39:
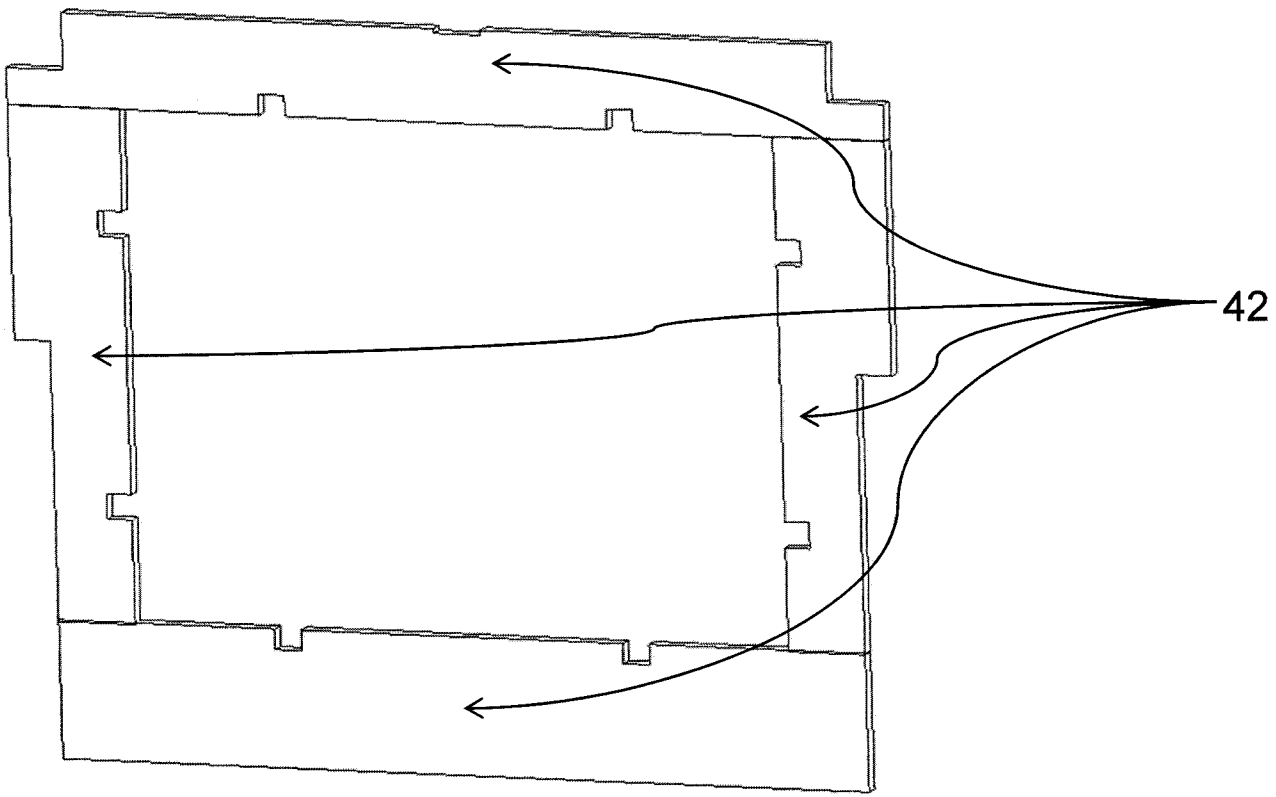
FIG. 39 is a conventional perspective view of the pieces of thermal isolating material which are placed surrounding the package of windows in FIG. 38.
Figure 40:
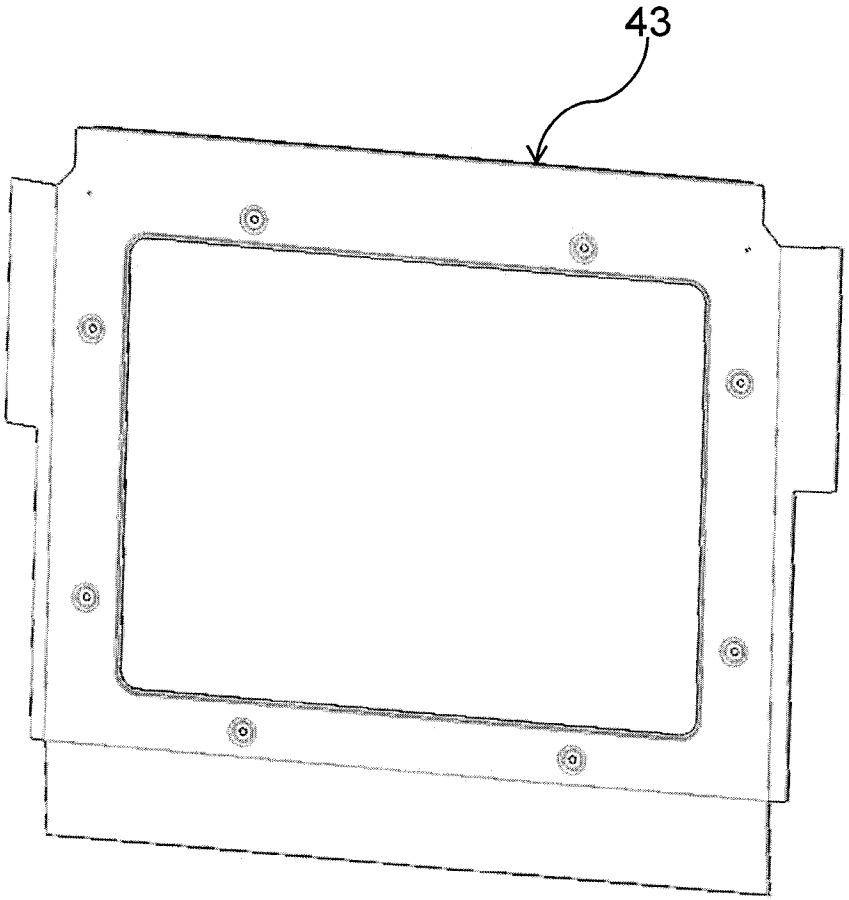
FIG. 40 is a conventional perspective view of an inner guard which fastens the pieces of thermal isolating material seen in FIG. 39 unto the counter door structure.
Figure 41:
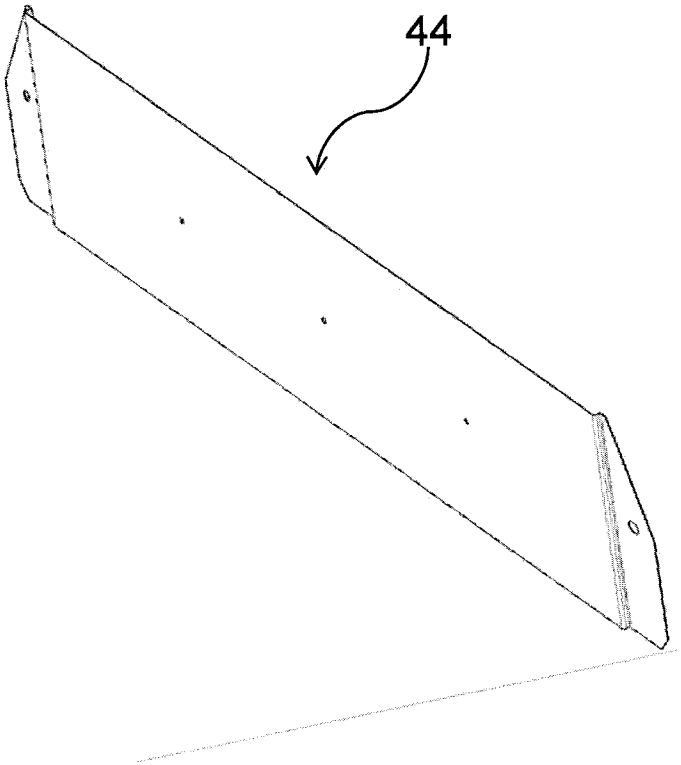
FIG. 41 is a conventional perspective view of an air deflector which is coupled unto the inner guard in FIG. 40.
Figure 42:
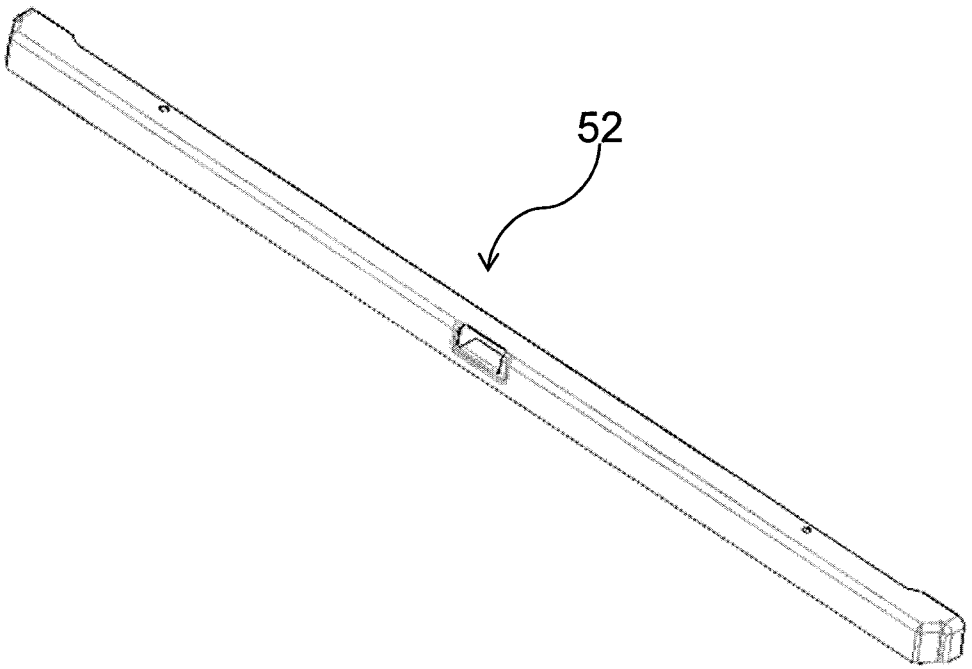
FIG. 42 is a conventional perspective view of the upper ratchet of the inner or back panel.
Figure 43:
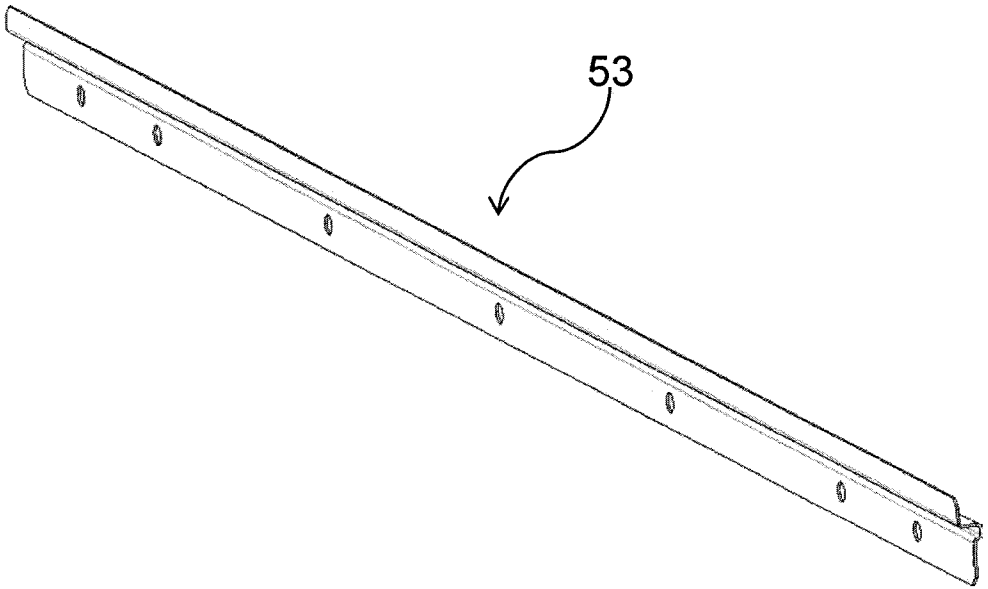
FIG. 43 is a conventional perspective view of the lower ratchet in an "L" shape of the inner or back panel.
Figure 44:
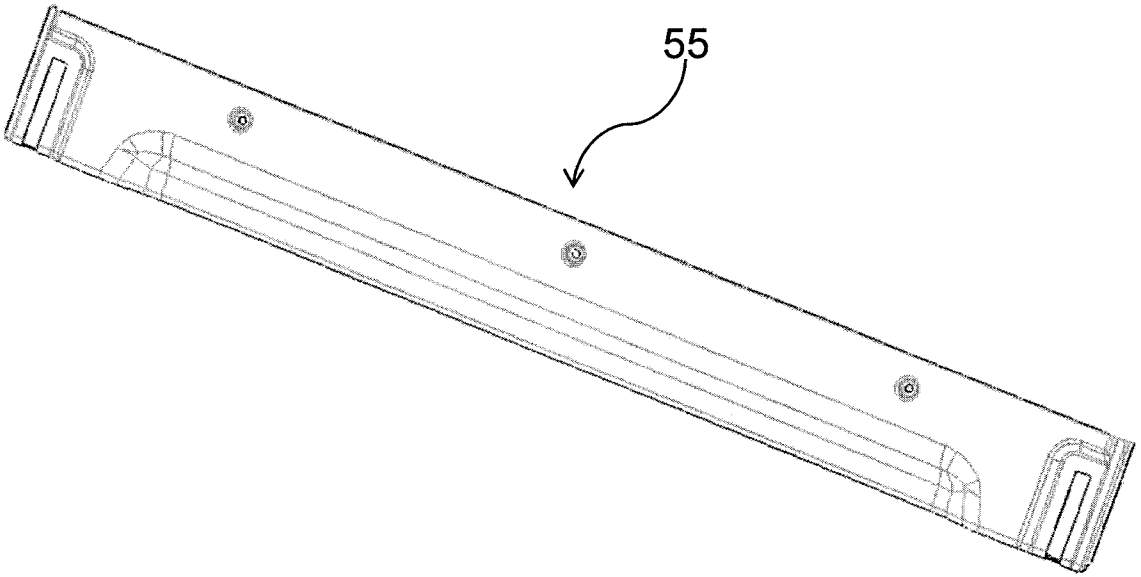
FIG. 44 is a conventional perspective view of the lower appearance ratchet of the inner or back side panel.
Figure 45:
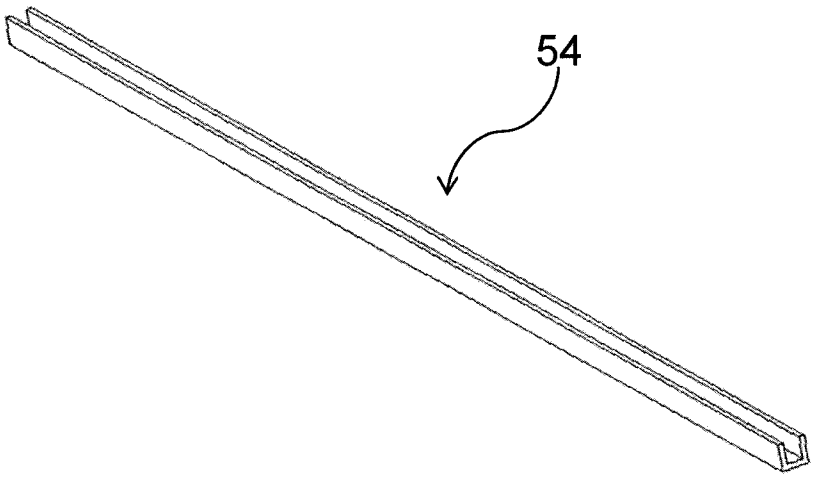
FIG. 45 is a conventional perspective view of one of the silicon seals in a "U" shape which are placed both on the upper border as well as on the lower border of the ceramic glass sheet of the inner or back panel.
Figure 47:
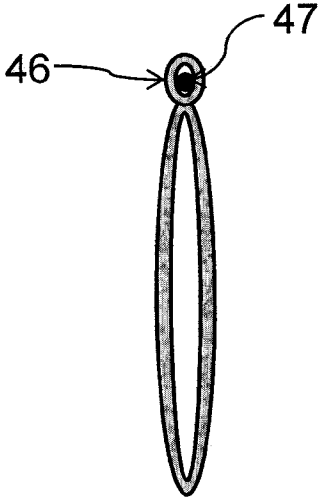
FIG. 47 is a cross section view of the thermal isolating seal seen in FIG. 46.
Figure 46:
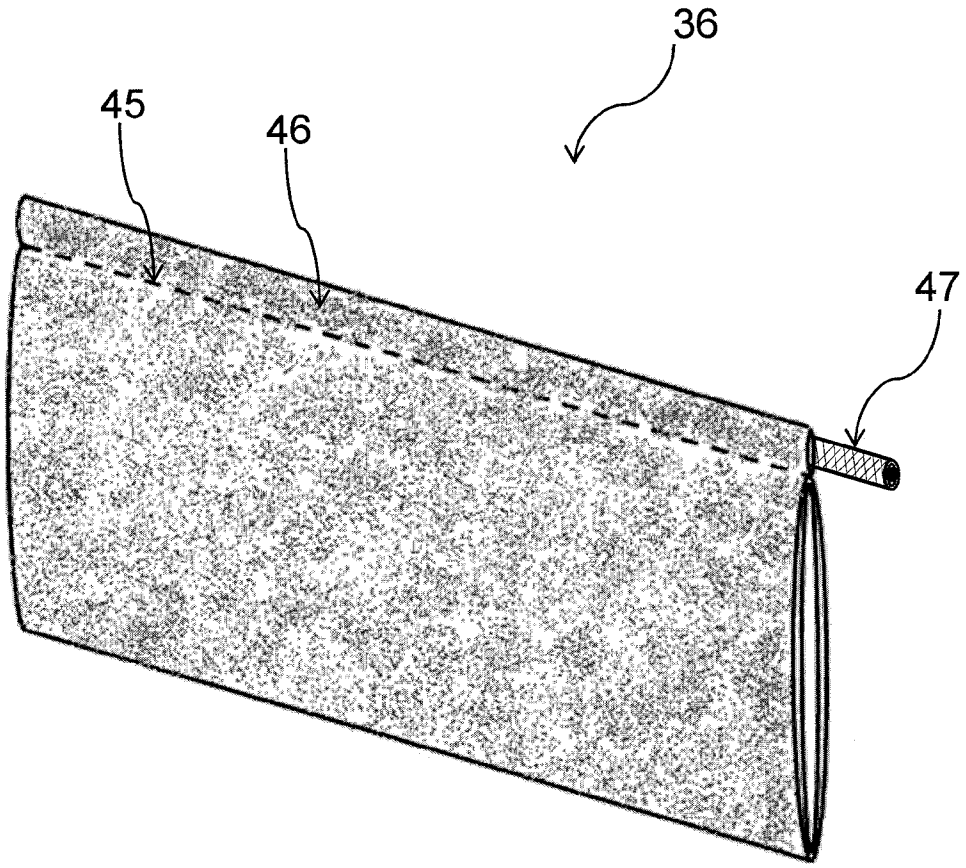
FIG. 46 is a detailed conventional perspective view of a section of the thermal isolating seal of the present invention.

Such as is shown in FIGS. 1 through 6, the present invention relates to a door (1) for the oven of a stove of the type which has an inner or back panel which is completely made of panoramic ceramic glass. More specifically, as can be seen in FIGS. 29 and 30, it relates to a panoramic door for an oven (1) which has a counter door structure (30) divided into two main parts and with an isolating thermal seal (36) interposed between each other in order to generate a thermal breaking.

The oven door (1) is mainly formed by an outer or front panel structure (10), a counter door structure (30) and an inner or back panel (50).

Figure 1:
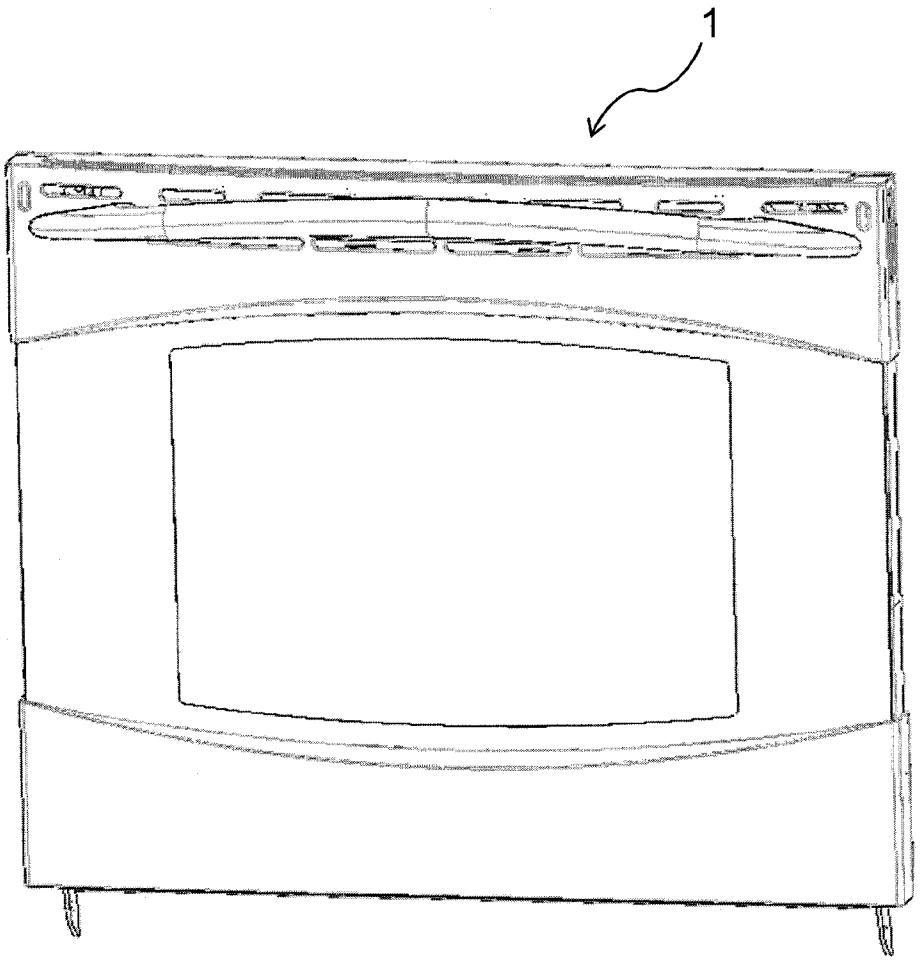
FIG. 1 is a conventional perspective view of the panoramic oven door of the present invention completely assembled.
Figure 2:
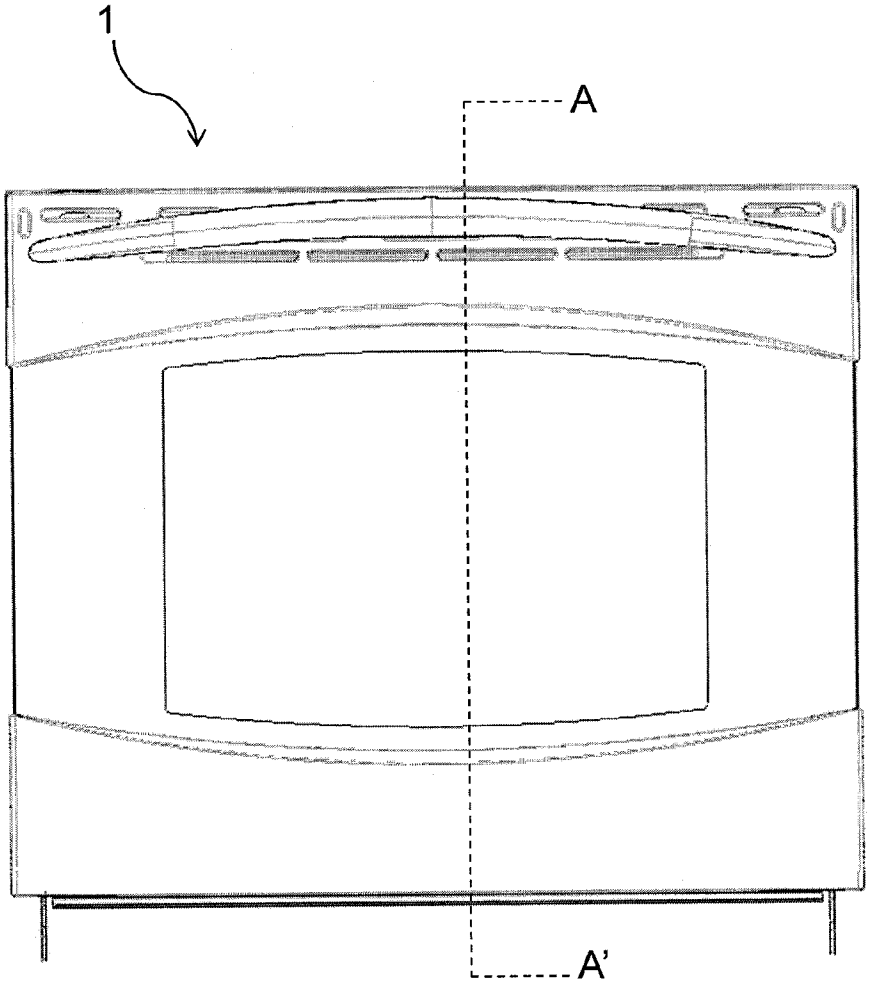
FIG. 2 is a front view of the oven door from FIG. 1.
Figure 3:
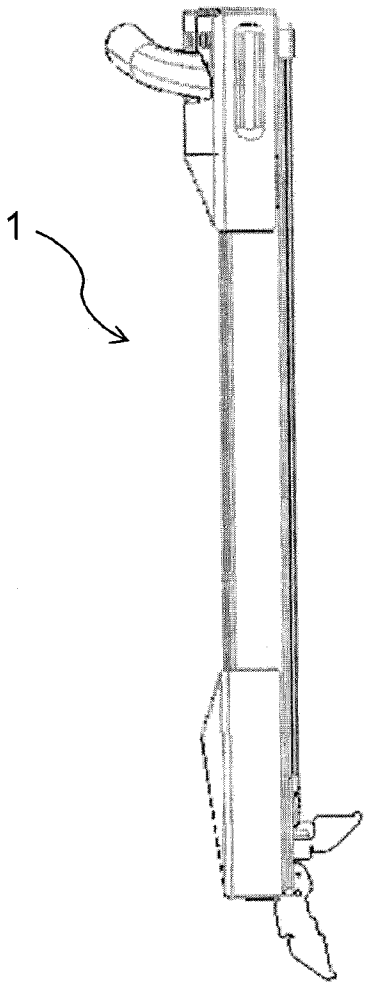
FIG. 3 is a lateral view of the oven door from FIG. 1.
Figure 4:
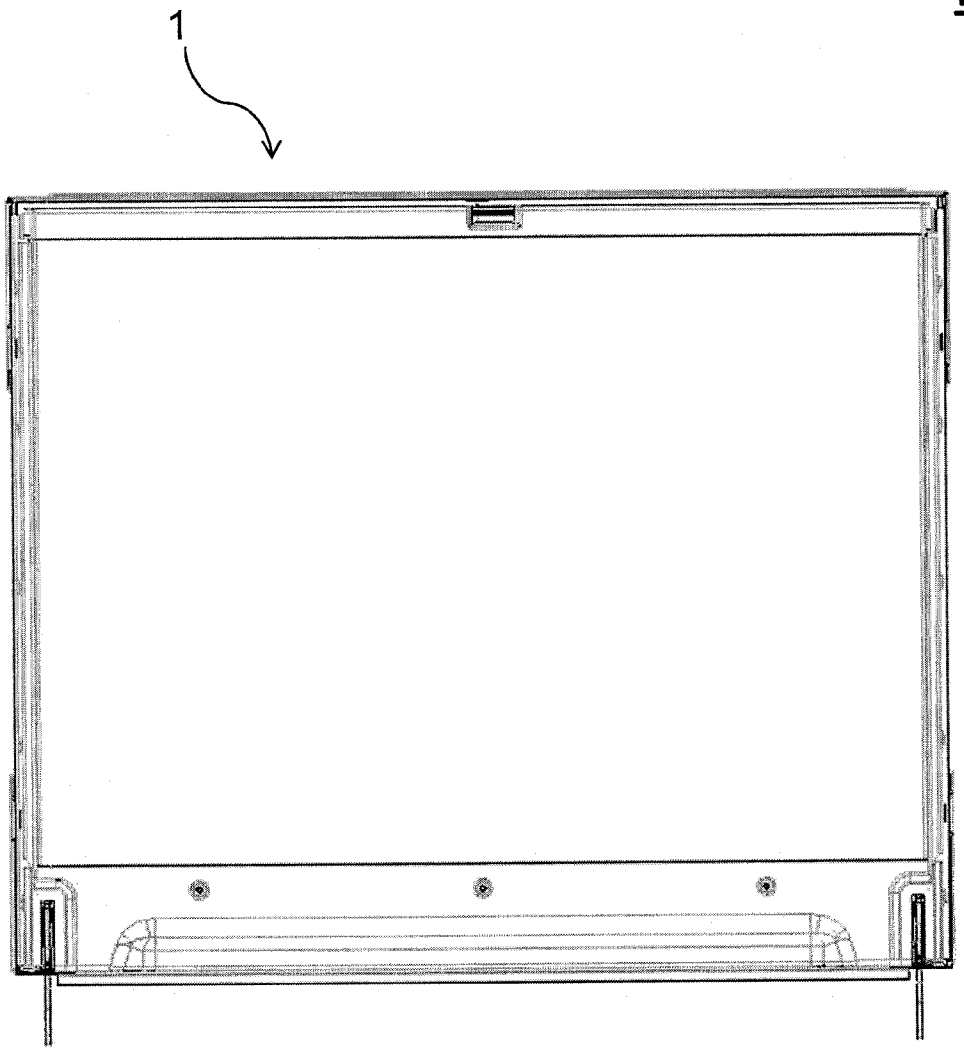
FIG. 4 is a back-side view of the oven door from FIG. 1.
Figure 5:
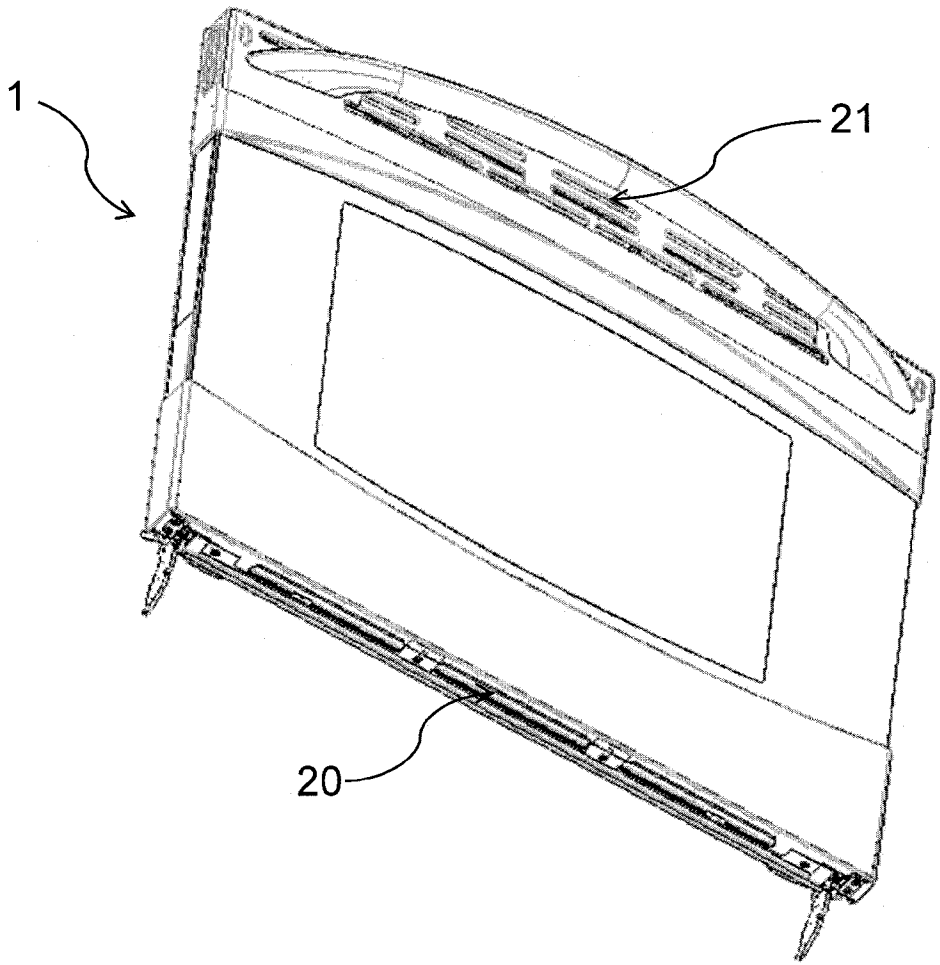
FIG. 5 is a lower perspective view of the oven door from FIG. 1.
Figure 6:
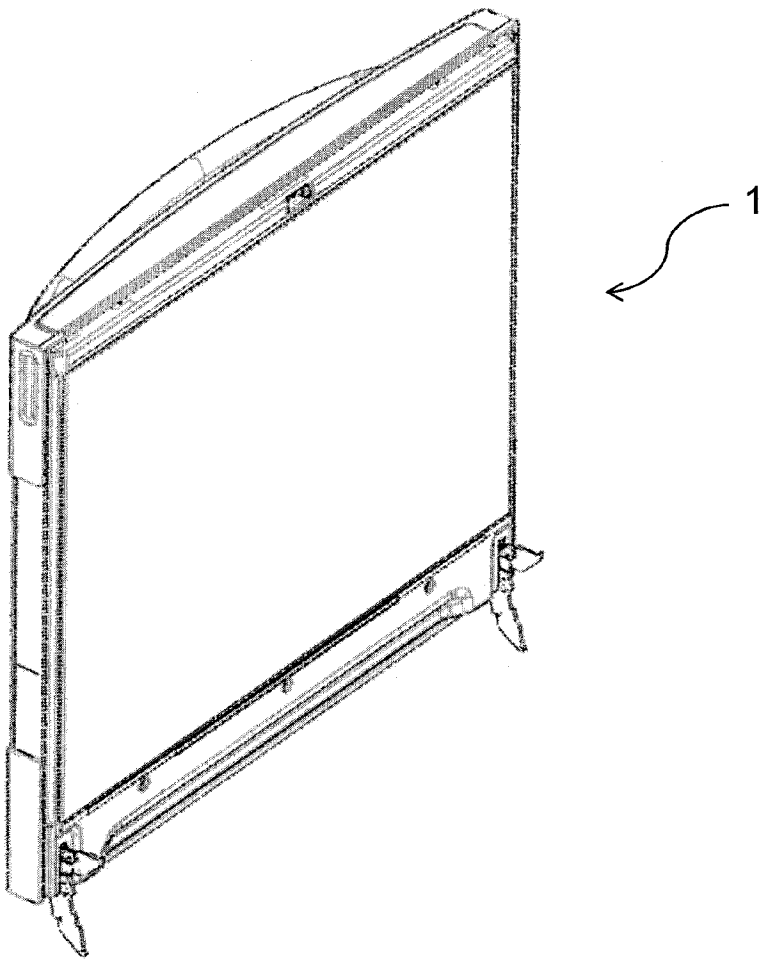
FIG. 6 is a back-side perspective view of the oven door from FIG. 1.
Figure 7:
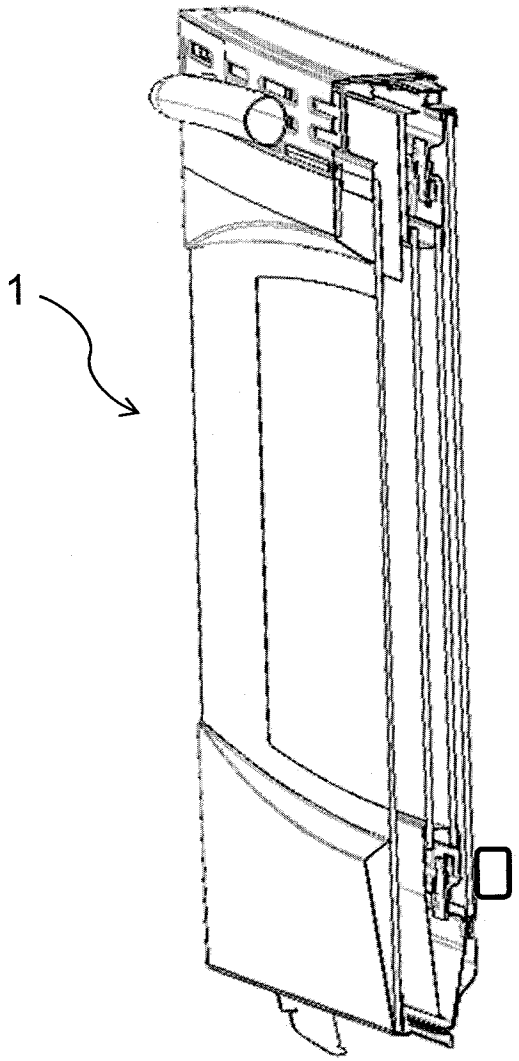
FIG. 7 is a cross-section and a conventional perspective view of the oven door from FIG. 1, along the length of lines A-A' from FIG. 2.
Figure 8:
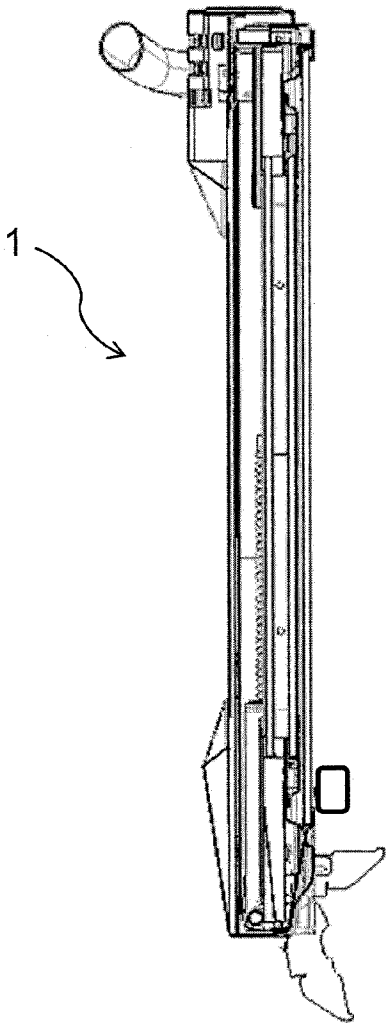
FIG. 8 is a cross-section of the oven door of the present invention along the length of lines A-A' seen in FIG. 2.
Figure 9:
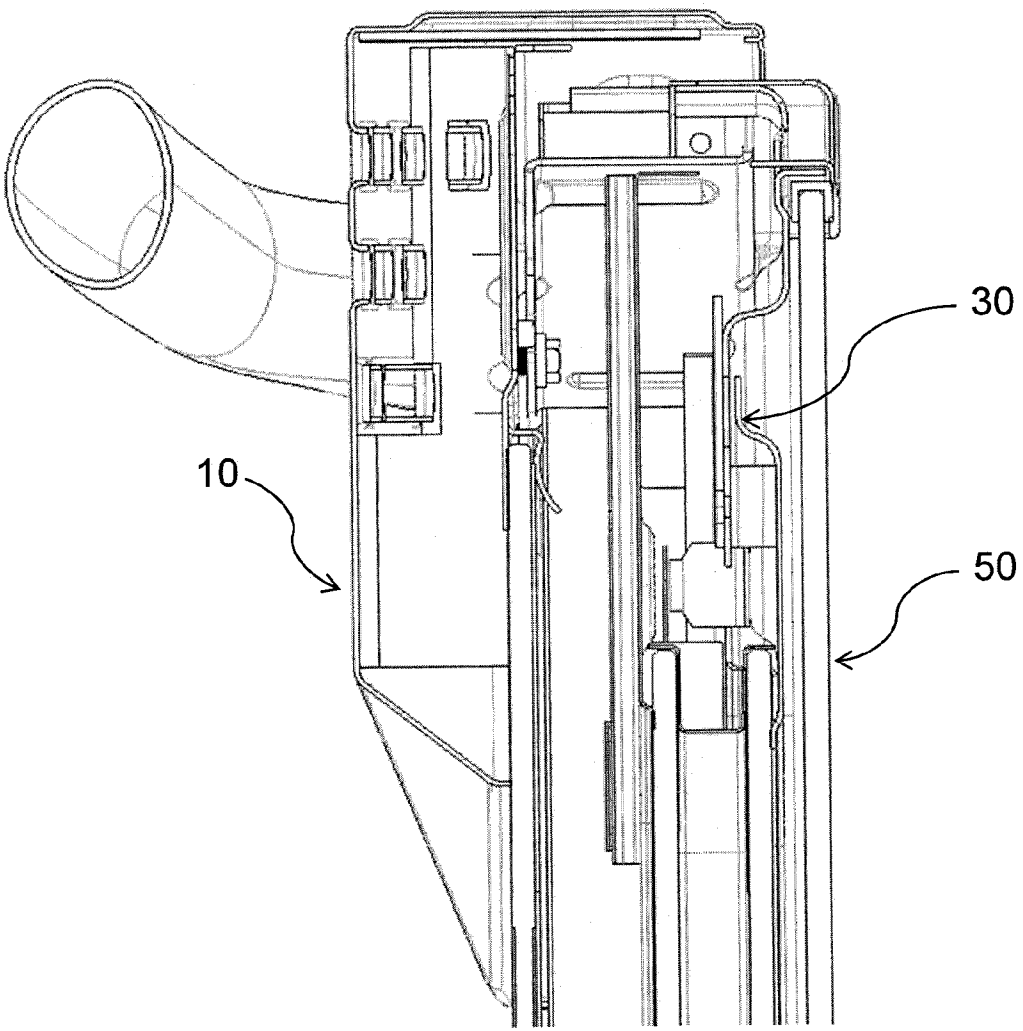
FIG. 9 is a detailed view of the upper section seen in FIG. 8.
Figure 10:
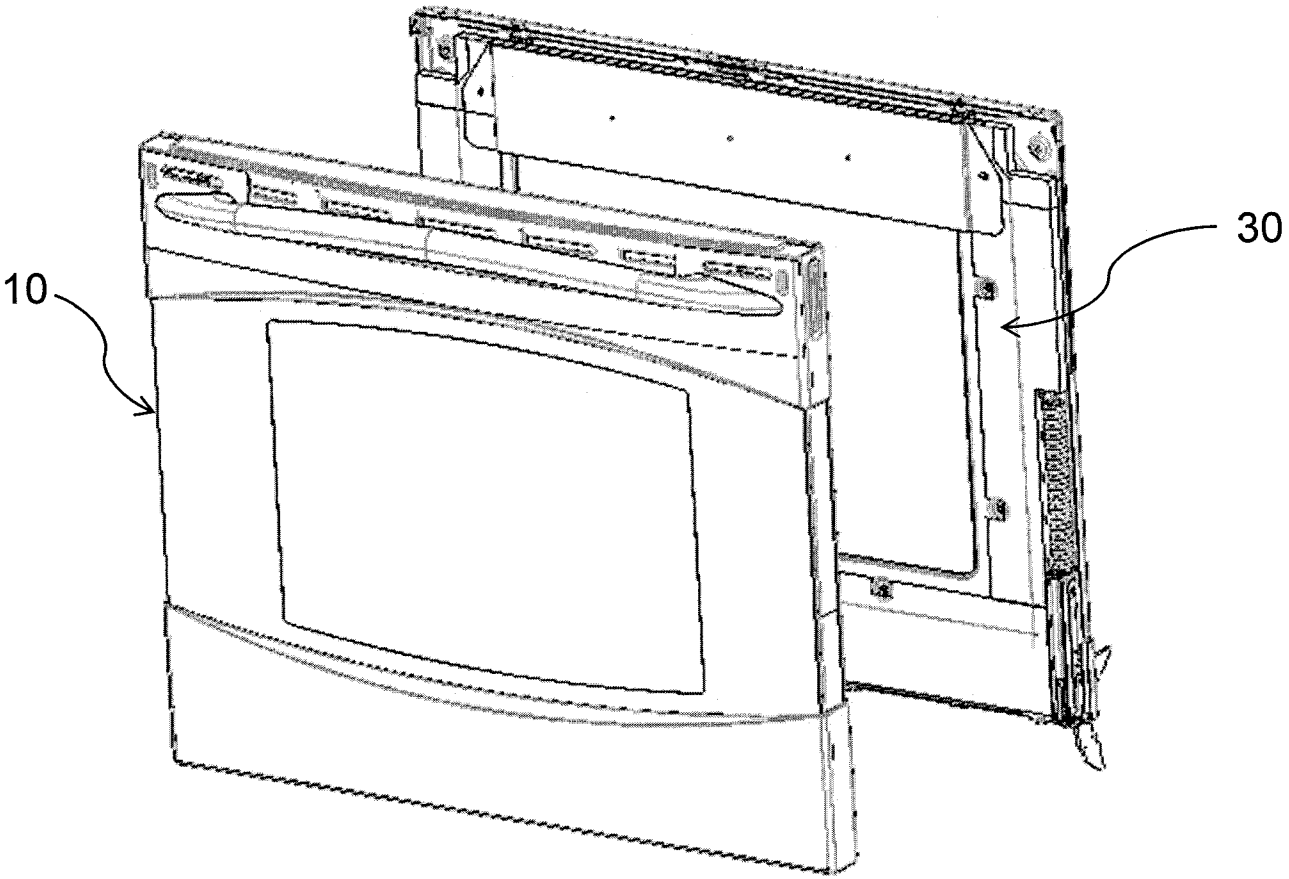
FIG. 10 is a view in conventional perspective of the oven door of the present invention, where the structure of the outer or front panel is separate from the same.
Figure 11:
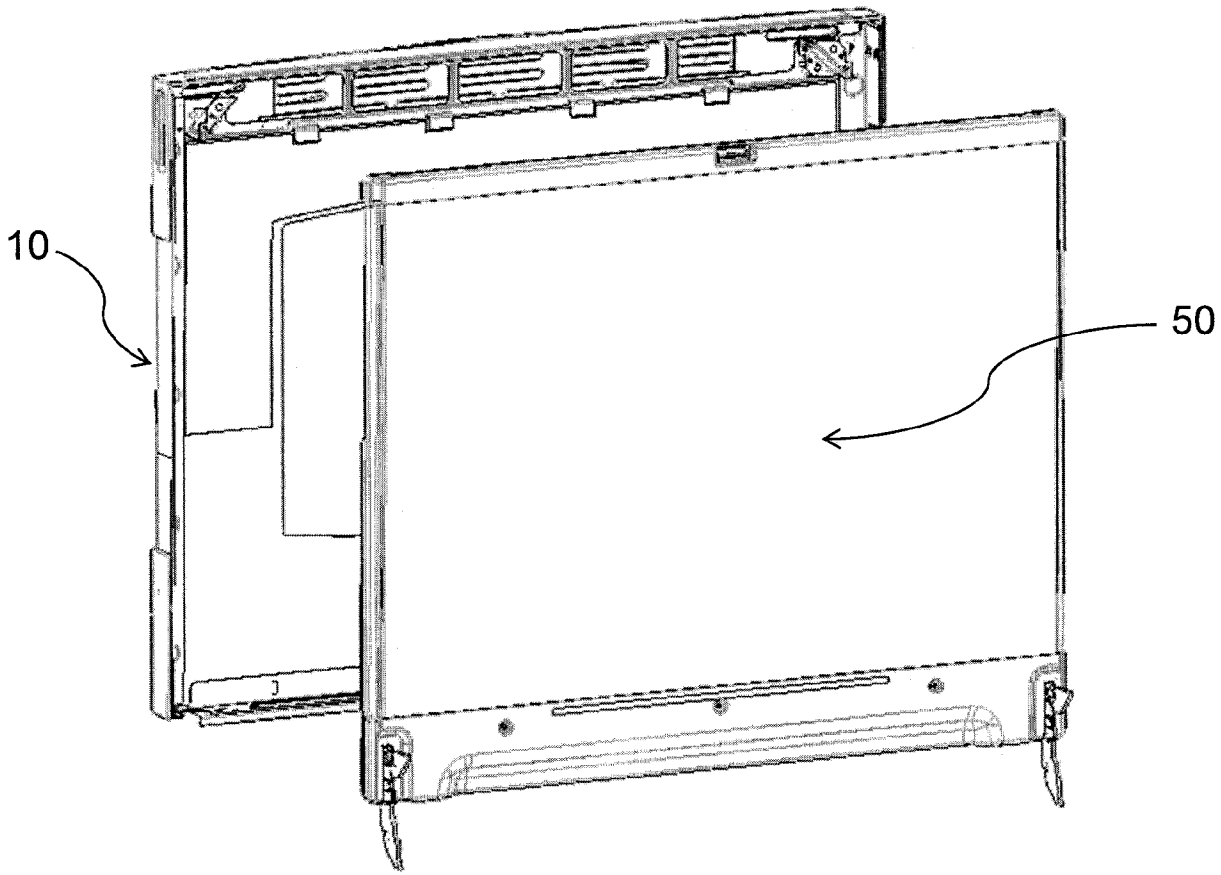
FIG. 11 is a back perspective view of FIG. 10.
Figure 12:
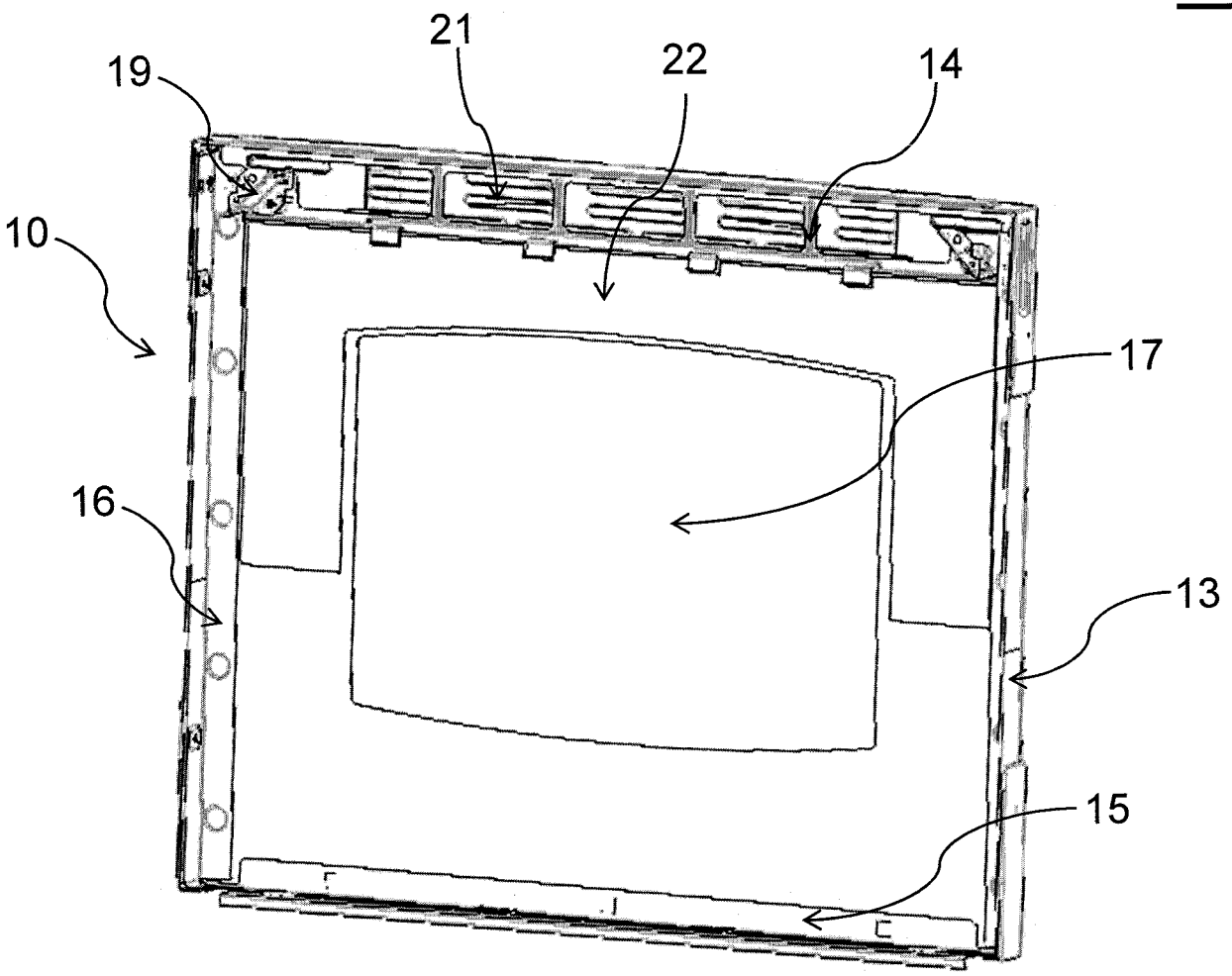
FIG. 12 is a back perspective view of the outer or front structure panel of the oven door.
Figure 13:
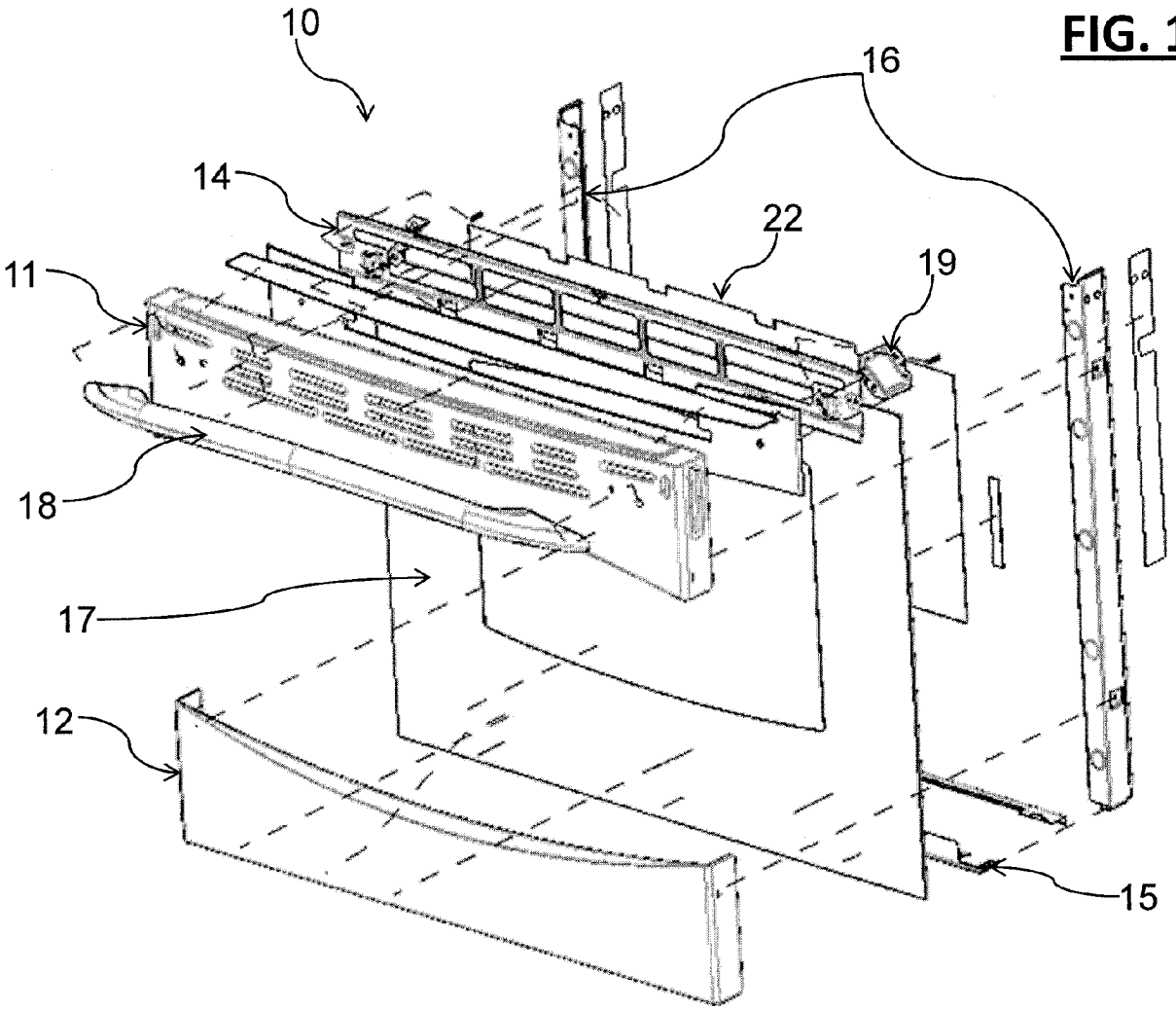
FIG. 13 is an exploded view of the assembly of the structure of the outer or front panel of the oven door of the present invention.
Figure 14:
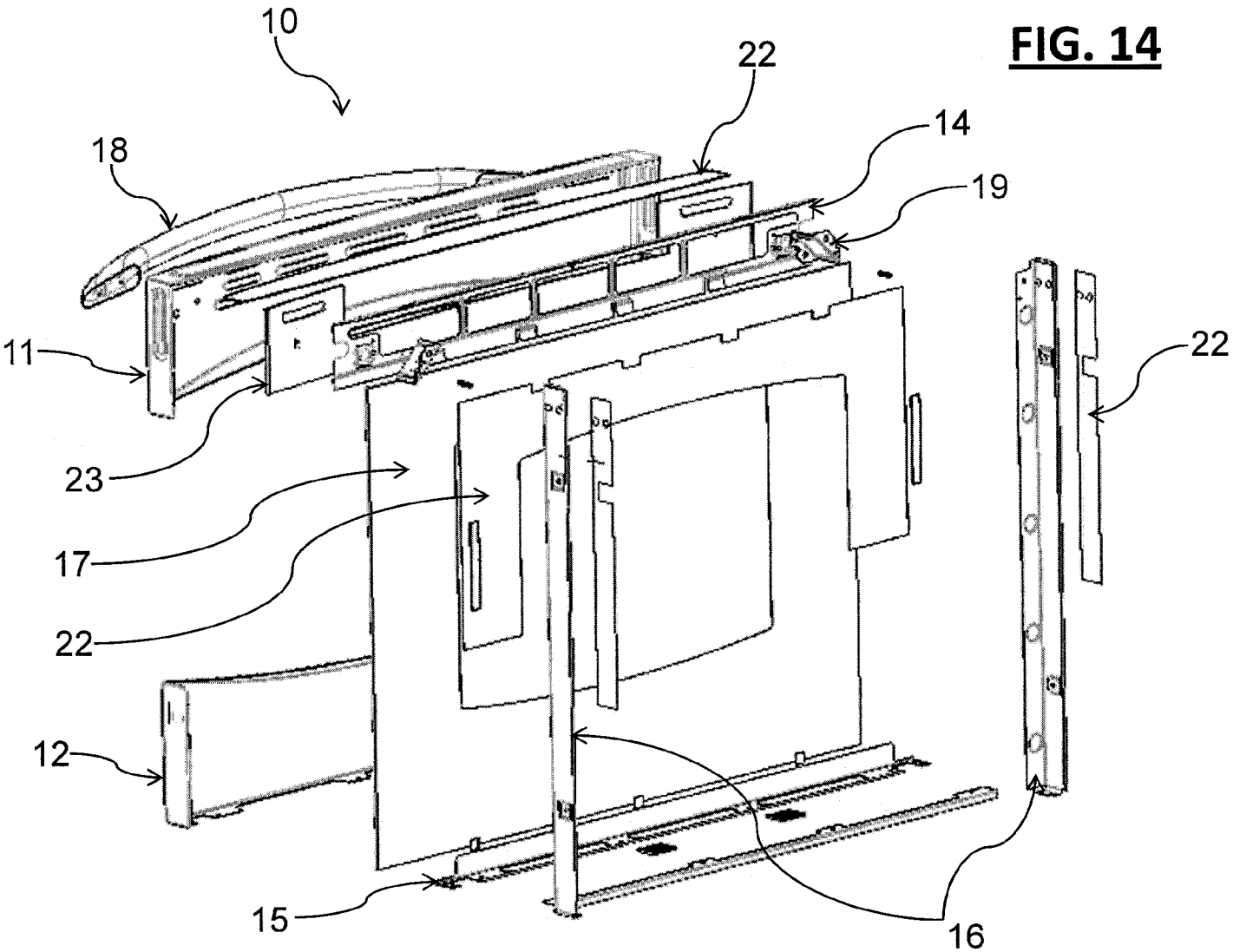
FIG. 14 is a back side perspective view of FIG. 13.
Figure 15:
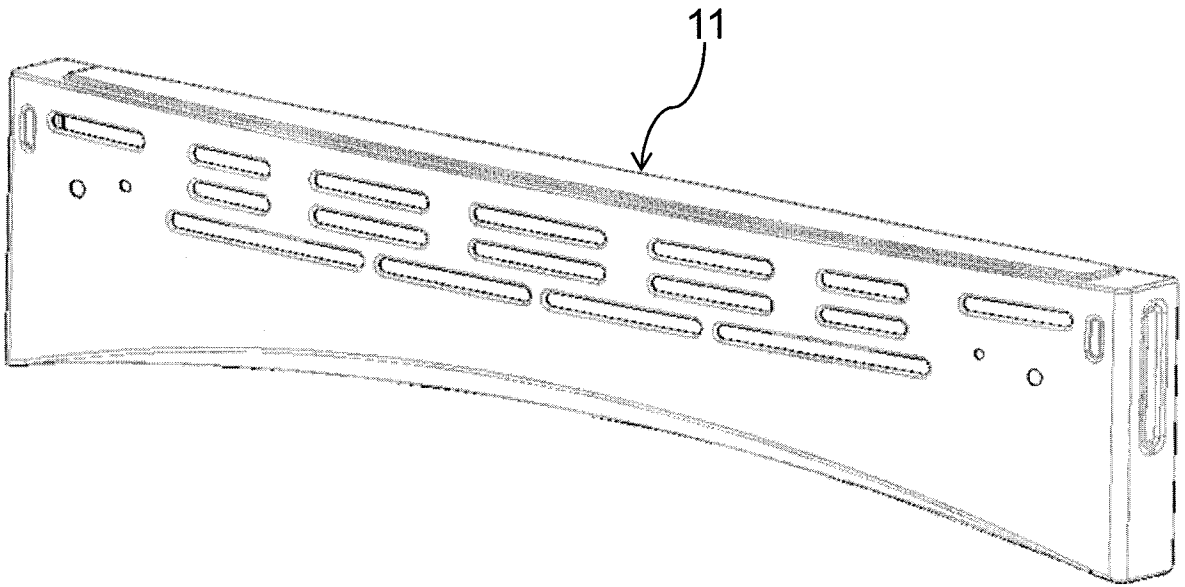
FIG. 15 is a perspective conventional view of the upper decorative appliqué of the outer or front panel structure.
Figure 16:
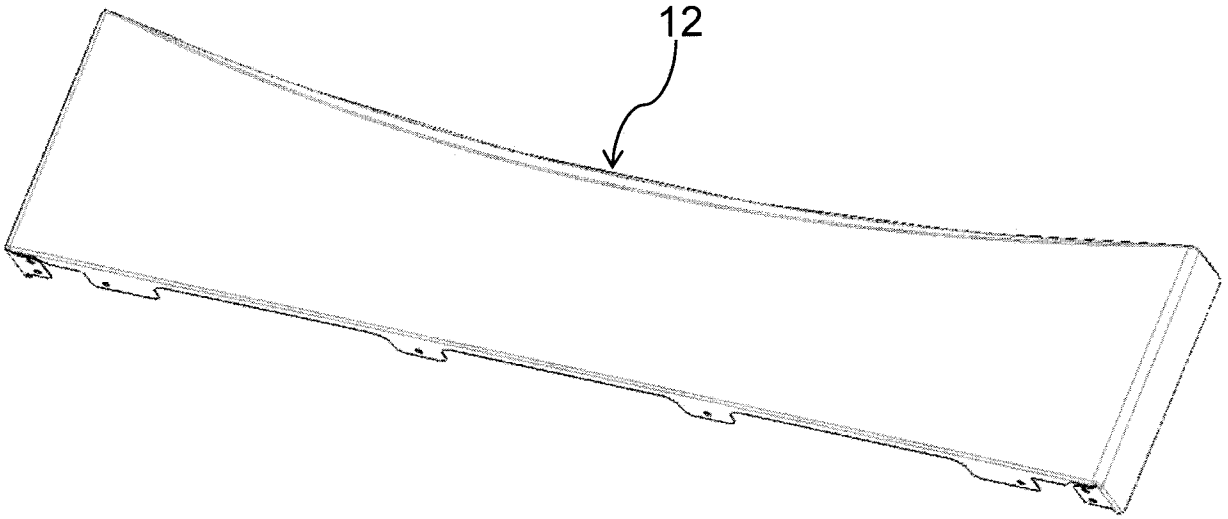
FIG. 16 is a perspective conventional view of the lower decorative appliqué of the outer or front panel structure.
Figure 17:
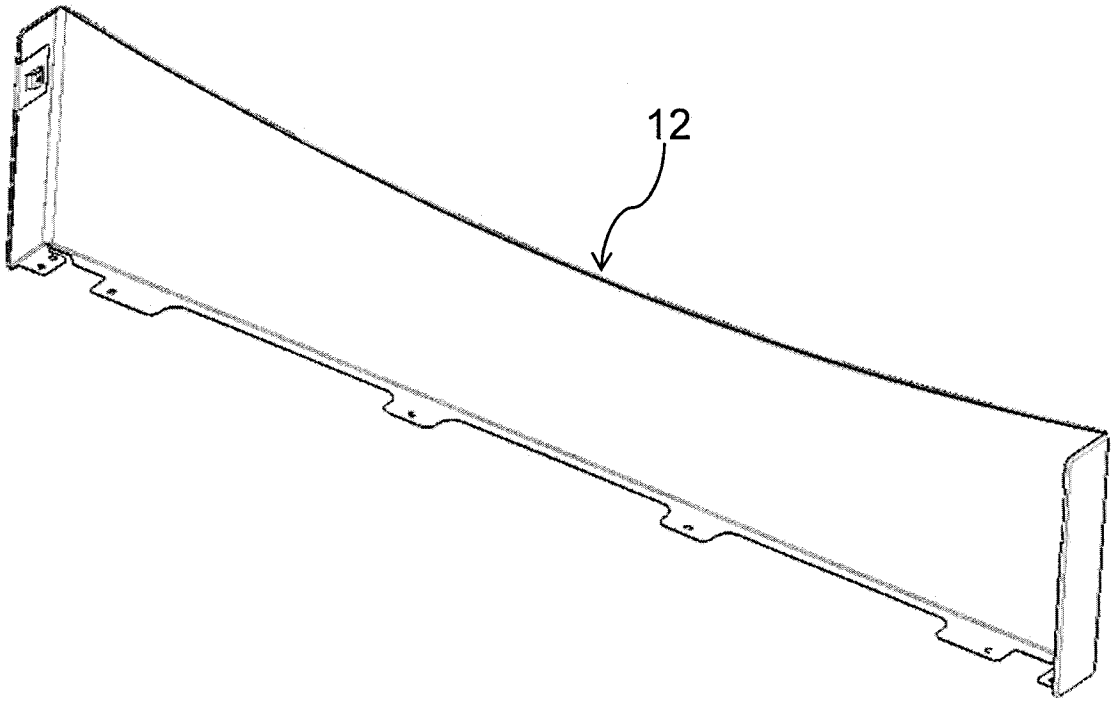
FIG. 17 is a perspective back side view of the lower decorative appliqué in FIG. 16.
Figure 18:
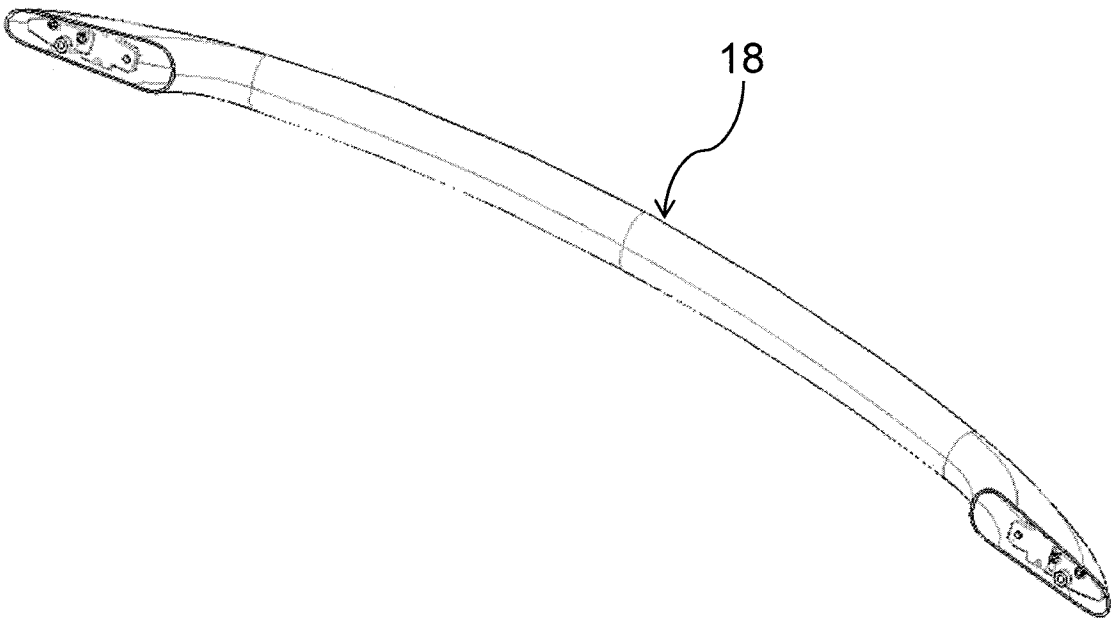
FIG. 18 is a back side perspective view of the handle for the oven door of the present invention.
Figure 19:
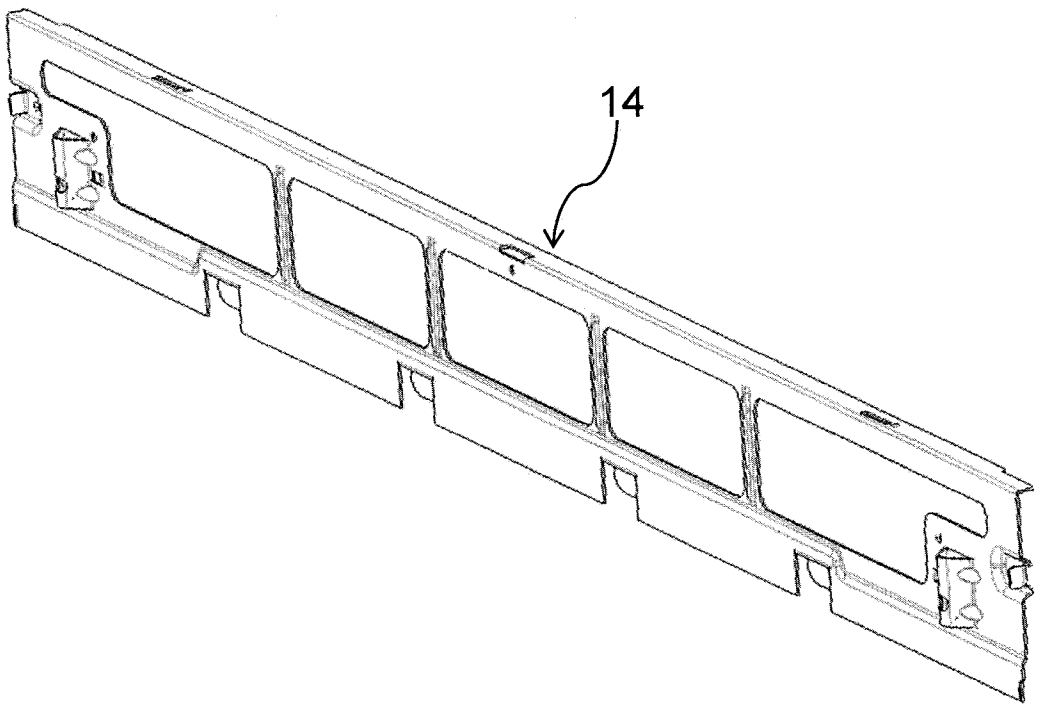
FIG. 19 is a perspective conventional view of the upper back support molding of the support frame on the outer or front panel structure.
Figure 20:
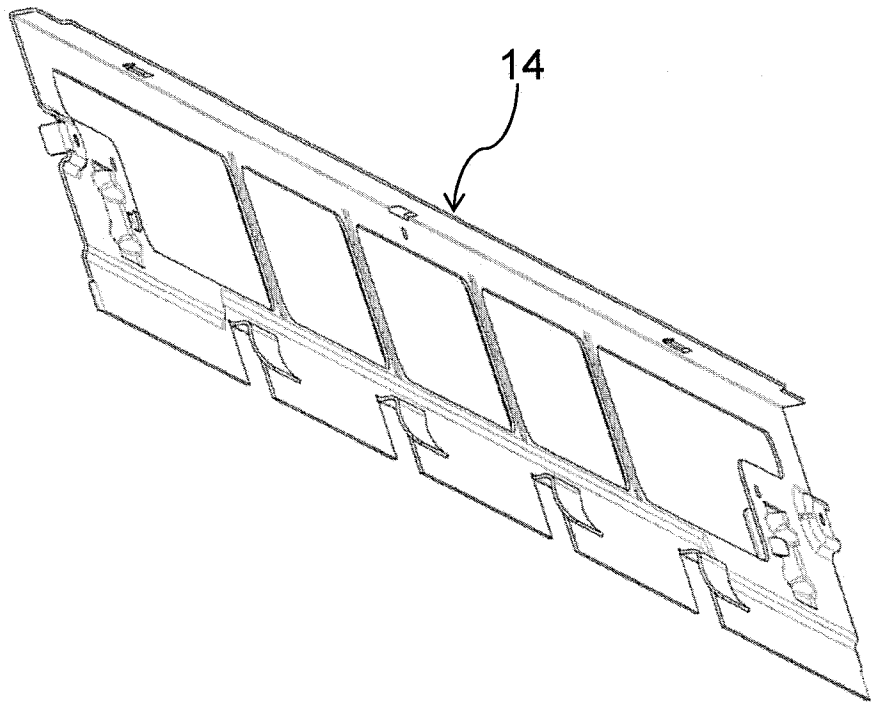
FIG. 20 is a back side perspective view of the upper back support molding seen in FIG. 19.
Figure 21:
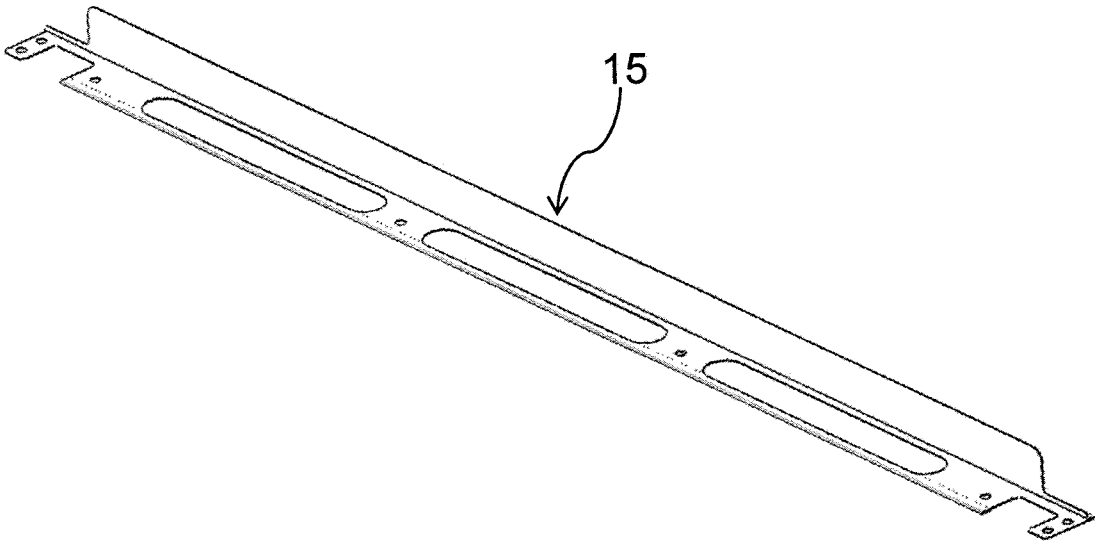
FIG. 21 is a conventional perspective view of the lower fastening molding of the support frame on the outer or front panel structure.
Figure 22:
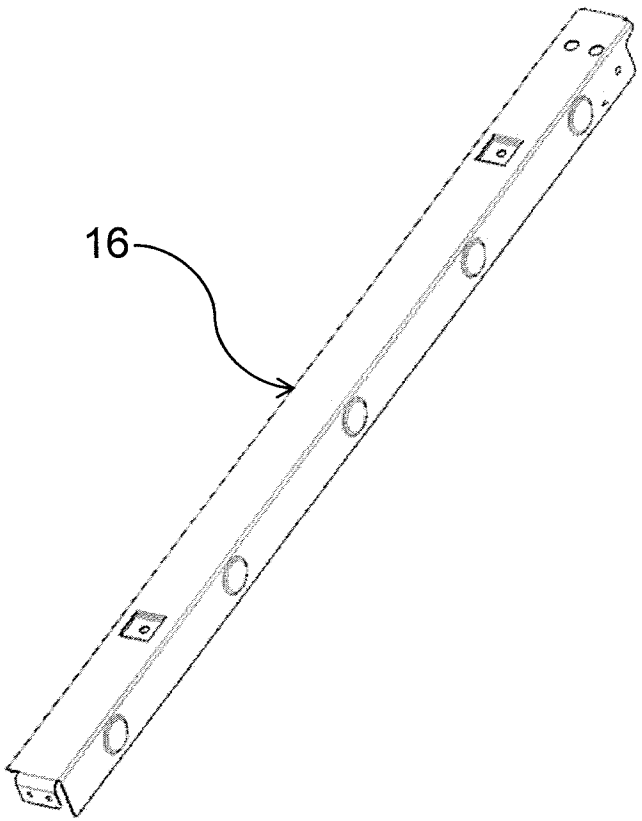
FIG. 22 is a conventional perspective view of one of the lateral posts of the support frame on the outer or front panel structure.
Figure 23:
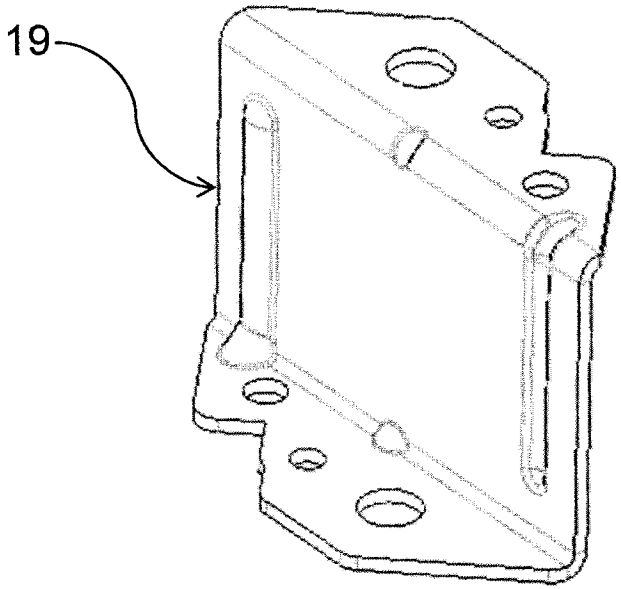
FIG. 23 is a conventional perspective view of one of the fastening brackets which are coupled to the upper back support molding.
Figure 24:
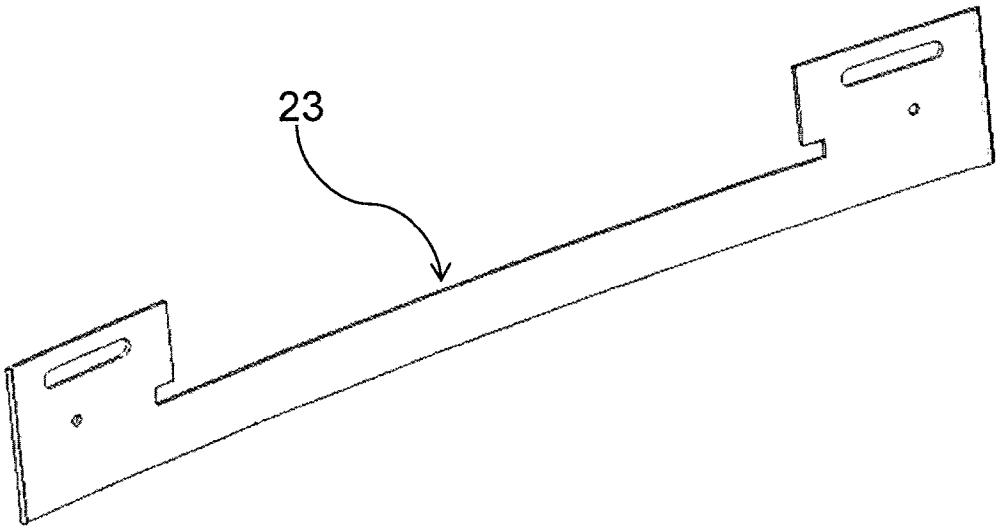
FIG. 24 is a conventional perspective view of an isolating fiberglass mask which is placed between the upper decorative appliqué and the upper back support molding.
Figure 25:
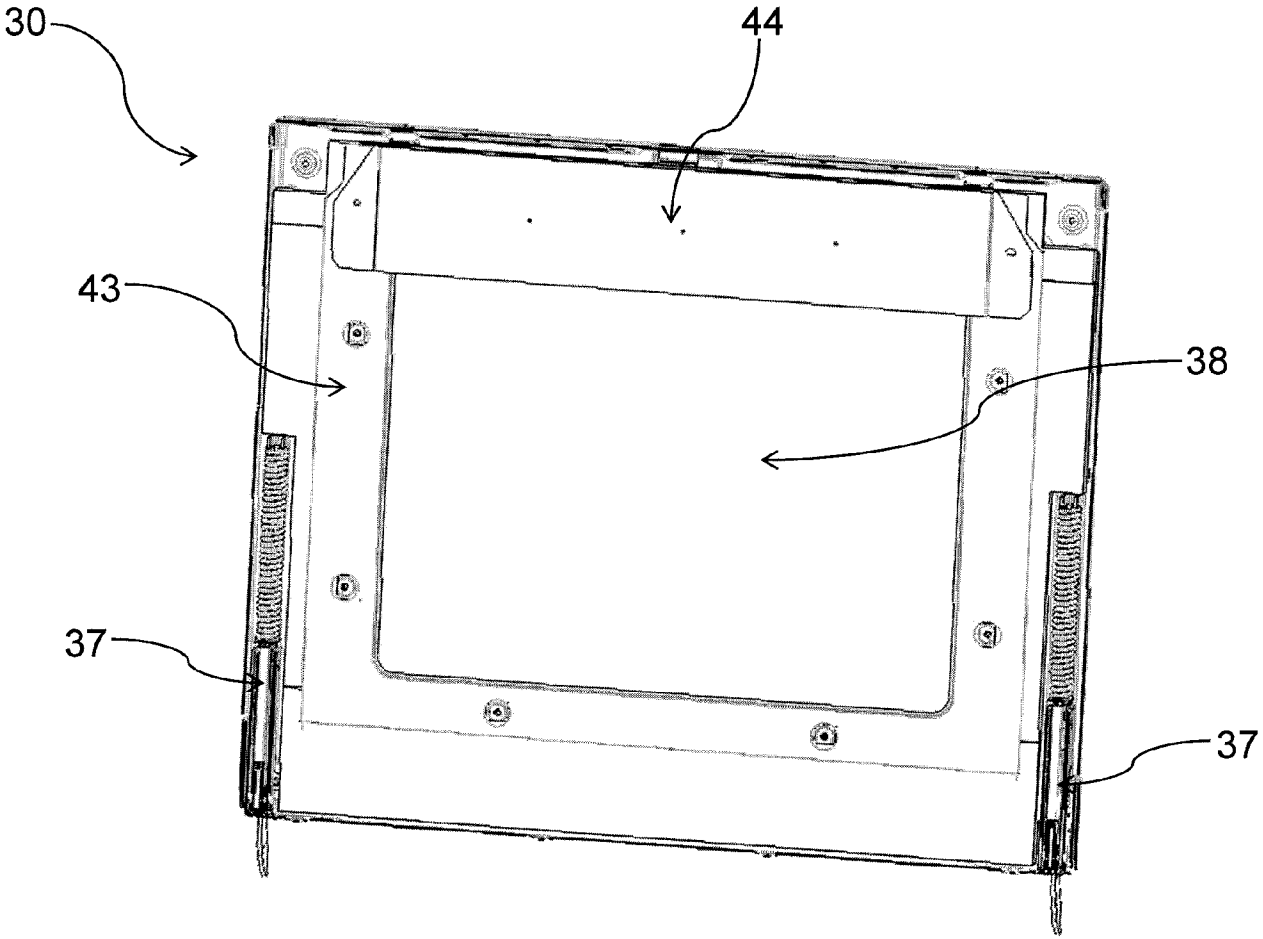
FIG. 25 is a conventional perspective view of the oven door without the outer or front panel structure.
Figure 26:
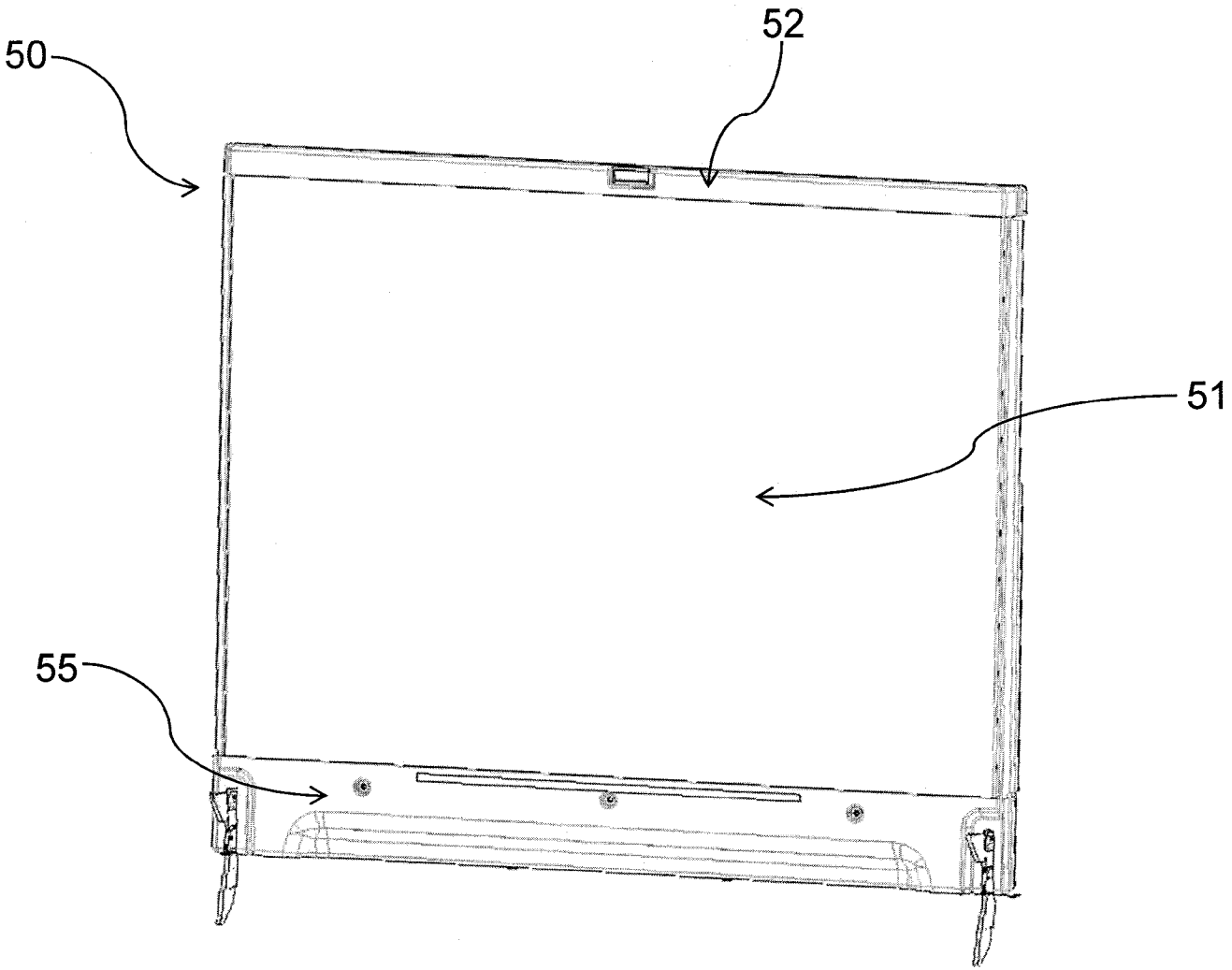
FIG. 26 is a back side perspective view of the oven door without the outer or front panel structure from FIG. 25.
Figure 27:
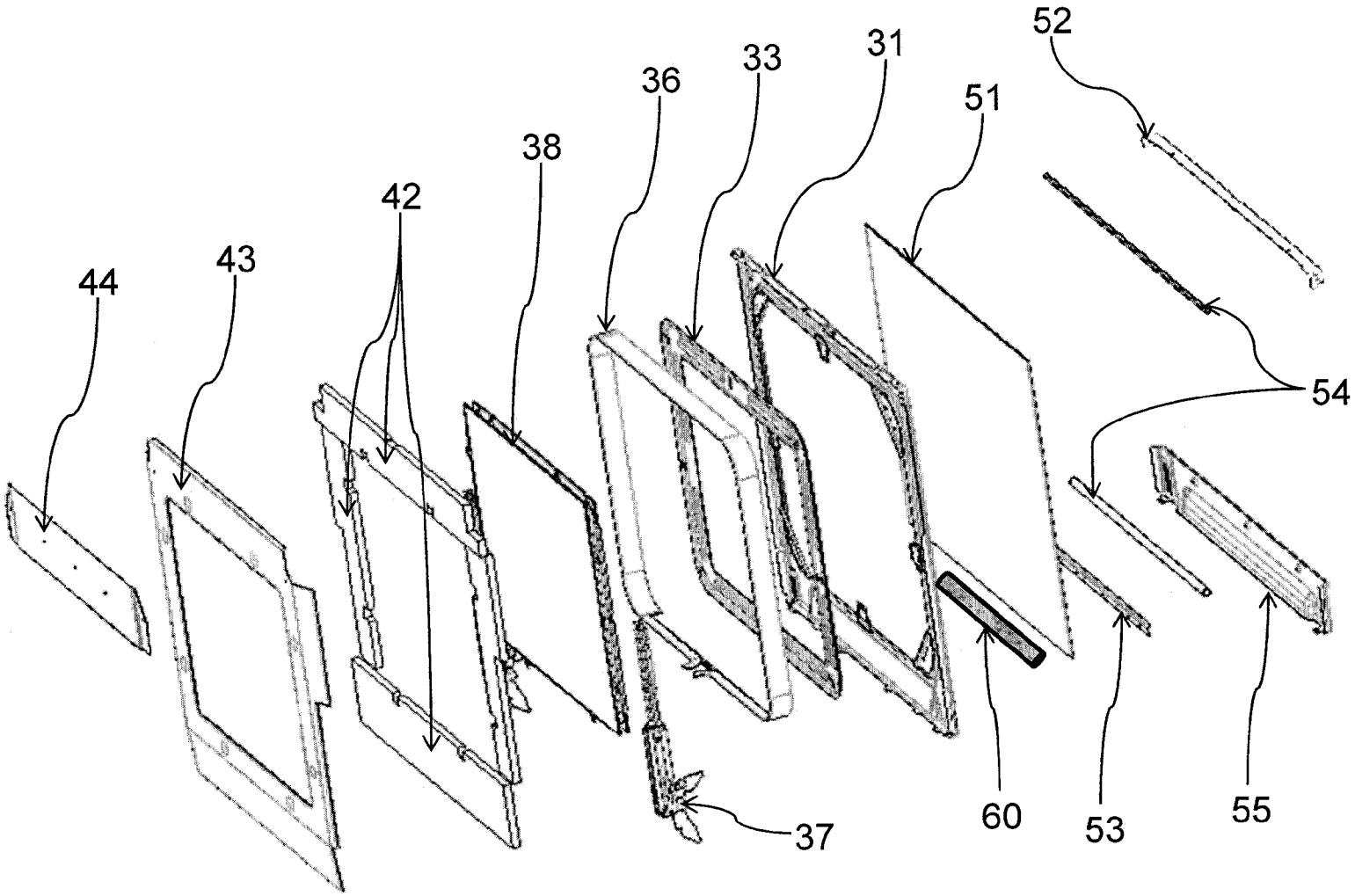
FIG. 27 is an exploded view of FIG. 25.
Figure 28:
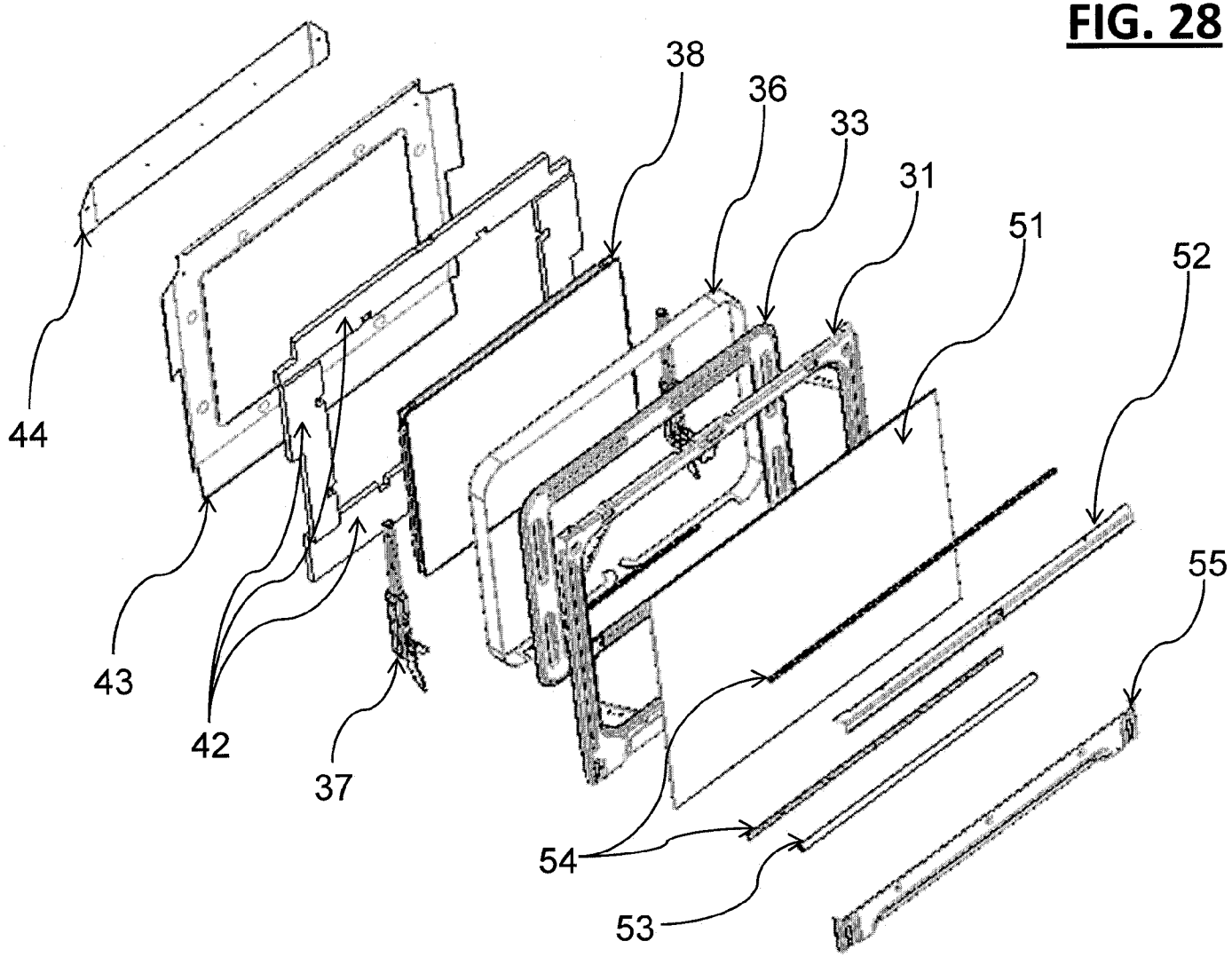
FIG. 28 is a back side perspective view of FIG. 27.

In the first place, as can be seen in FIGS. 12 through 24, the outer or front panel structure (10) is built by at least one upper decorative appliqué (11) and at least one lower decorative appliqué (12) fastened together on their back part by a support frame (13) formed by an upper back support molding (14), a lower fastening molding (15) and lateral posts (16) joined by fastening element means. Said support frame (13) is also responsible of supporting a panoramic glass sheet (17) between itself and the upper (11) and lower (12) appliqués, in such a way that from the front part view of the structure of the outer panel (10), only the panoramic glass (17) and the appliqués (11, 12) can be seen, which can be made of stainless steel for example or any other type of material to achieve the preferred appearance. Similarly, on the front part of said outer panel structure (10), a handle (18) is coupled by fastening means which cross over the upper appliqué (11) towards a couple of fastening brackets (19) coupled to the upper back support molding (14) for its own support. Additionally, with the end purpose of attaining better thermal isolation between the assembly of the previously mentioned parts which form the outer or front panel structure (10), several sheets of reflecting material (22) are conveniently set, covering for example, completely or merely on specific parts, the upper back support molding (14), the lower fastening molding (15), the lateral posts (16), the panoramic sheet of glass (17) and the decorative upper appliqués (11) as well as the lower ones (12). In similar fashion, an isolating mask (23) made of fiber glass can be found, such as is shown in FIG. 24, between the assembly of the upper appliqué (11) and the upper back support molding (14) with the end purpose of maximally avoiding heat transfer between all the parts; or in their case, also between the panoramic sheet of glass (17) and the decorative appliqués (11, 12) or the parts which form the support frame (13).

Figure 48:
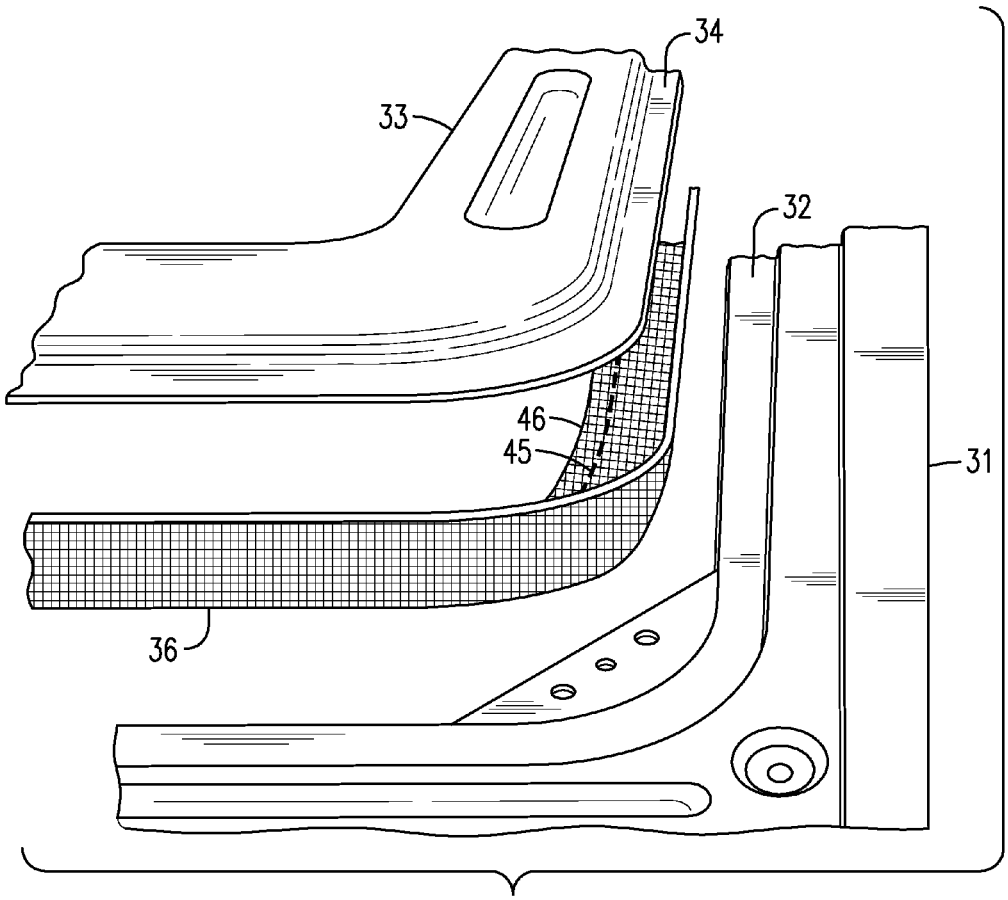
FIG. 48 is an exploded, isometric view of the mutually opposed sections of the counter door and the thermal isolating seal disposed between such counter door sections.
Figure 49:
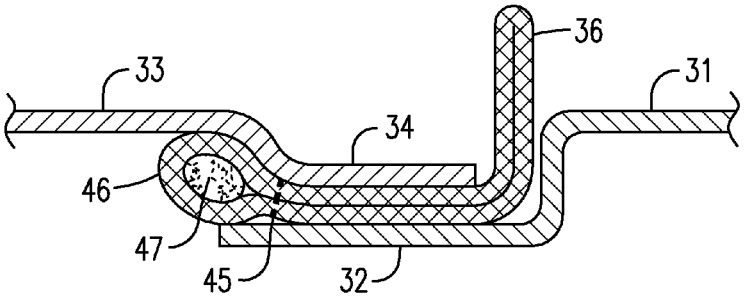
FIG. 49 is a cross-sectional view of the counter door sections and the thermal isolating seal disposed between such counter door sections.

On the other hand, as can be seen in FIGS. 25 through 41 and 46 and 47, the counter door structure (30) comprises a first outer section of counter door (31) in the shape of a substantially rectangular structural frame which has a support groove (32) surrounding its inner perimeter border; a second inner section of counter door (33) in the shape of the substantially rectangular structural frame which has a coupling flange (34) surrounding its outer perimeter border; said first (31) and second (33) sections of the counter door are coupled between themselves by means of a plurality of brackets and supports means of fastening (35) formed over the same, coincidentally, when sections 31, 33 are coupled between themselves and joined by means of fastening elements, in such a way that said coupling flange (34) from the second inner counter door (33) section is made to coincide within the support groove (32) formed in the first outer section of the counter door (31). As may be appreciated in greater detail in FIGS. 48 and 49, an isolating thermal seal (36) manufactured of fiberglass thread in the shape of a substantially flat hose is placed interposed between said coupling flange (34) and said support groove (32) once they are coupled securely, in order to avoid direct contact between both sections (31,33) of the counter door (30) creating a thermal breaking between them; said thermal isolating seal (36) also has a seam (45) found close to one of its borders and is parallel along the length of the same, forming a tubular section (46) of lesser diameter along the length of the border of the seal (36), within which is introduced an additional fiberglass cylindrical seal (47) of a smaller diameter and woven substantially in the shape of a braid, resulting in a lateral border which serves as an obstruction element for the seal itself (36) and at the same time as cushioning and isolating for the inner or back ceramic glass panel (50) which, once the door (1) is assembled, rests on the counter door (30), thus avoiding in this way, direct contact with the same. Specifically, an excess portion of the thermal seal (36) which is not imprisoned between said first (31) and second (33) counter door sections, helps to support over the same the ceramic glass sheet (51) of the inner or back panel once it is placed over the counter door (30) to avoid direct contact between both making the heat transfer more difficult in addition to cushioning the vibrations. Additionally, a pair of hinges (37) is coupled by fastening means to the sides of the first outer section of the counter door (31) in order to be able to assemble in a hinged manner said oven door (1) unto a cavity of a stove's oven.

Lastly, as can be seen in FIGS. 26 through 28 and 42 through 45, the inner or back panel (50) consists solely of one ceramic glass sheet (51) which is coupled unto the structure of the counter door (30) by means of an upper catch (52) and a lower catch (53), preferably in an "L" shape, fastened to said counter door (30) by means of fastening elements. Both on the upper border as well as on the lower border of the ceramic glass sheet (51) a silicon seal (54) is placed which is preferably in a "U" shape, which prevents said ceramic glass sheet (51) from coming into direct contact with any metallic part whether it be the counter door (30) or said upper (52) or lower (53) ratchets, thus maximally avoiding any heat transfer by conduction between the same.

In this manner, the structure of the outer or front panels (10) is assembled unto the structure of the counter door (30) by means of fastening elements such as screws, rivets, bolts, soldering joints or any other type of adequate means. It is important to highlight that said fastening means are set solely on the first outer section (31) of the counter door (30), being coupled to the fastening brackets (19) of the upper back support molding structure (14) and generally, to the support frame (13) of the front panel structure (10), avoiding the possibility of any direct contact between the inner second section (33) of the counter door (30) and the outer or front panel structure (10), thus maximally avoiding through this heat transfer by means of conduction between both, given that said second inner section (33) of the counter door (30), through its location and geometry, is the part which indirectly receives the largest portion of the heat emanating from the oven's cavity. Because of this is that given the isolating thermal seal (36) placed between the first outer section (31) of the counter door (30) and the second inner section (33) of the counter door (30), a thermal breaking between both is caused, avoiding to a large degree the heat transfer absorbed by said second inner section (33) of the counter door towards said first outer section (31) of the counter door, and at the same time towards the structure of the outer panel or front part (10) of the door (1).

Coupled to the above, between said structure of the outer panel (10) and said structure of the assembled counter door (30), there remains a space through which the air can circulate from the at least one opening (20) formed on the lower part of the structure of the outer or front panel (10) (through both the lower appliqué (12) as well as the fastening lower molding (15)), through the at least second opening (21) formed on the upper part of the structure of the outer or front panel (10) (through both the upper appliqué (11) as well as the upper back support molding (14)), with the end purpose of helping to reduce the temperature of the door (1) when the oven is found in functioning mode. Within said space between both structures (10,30) a package of windows (38) is placed formed by at least one and preferably at least two sheets of tinned glass (39) substantially parallel to each other, which are mounted on a metallic frame (40) set around the same to fasten them and to maintain them at a certain predetermined separation; said frame (40) is joined to a second inner section (33) of the counter door (30) by means of fastening brackets (41) and fastening means in such a way that the package of windows (38) is centrally placed on the inner perimeter border of the second inner section of the counter door (33). Additionally, surrounding said package of windows (38), pieces of thermal isolating material (42) are conveniently placed supported by an inner guard (43) such as could be a sheet frame, preferably metallic, which in turn is fastened unto the counter door structure (30) by means of fastening elements itself. In addition to the above, also coupled, preferably along the length of the upper part of said inner guard (43), is an air deflector (44) which has a chimney-style function to deviate and/or stop the air heated by convection which circulates from the lower part of the door (1) to make it colder, thus impeding that this collide directly unto the handle (18) once it exits through the upper part of the door (1), thus avoiding that said handle be heated through this means.

In a complementary manner, the sheet of ceramic glass (51) of the inner or back side panel (50) is assembled unto the counter door structure (30) by means of an upper ratchet (52) and a lower ratchet (53) preferably in an "L" shape, fastened to said counter door (30) by means of fastening elements, such as those described previously. It is worth highlighting that between the lower part of the second inner section (33) of the counter door and the ceramic glass sheet (51), a supplementary thermal seal (60) is placed in a longitudinal direction, made of fiberglass thread in tubular shape with the core being made of steel, through which a greater separation is accomplished and as such, a better thermal isolation between both parts (33, 51) is attained, in addition to also providing better cushioning from the impacts and vibrations which could arise. Additionally, a lower decorative ratchet (55) can be placed over the lower ratchet (53), preferably in an "L" shape coupled to the structure of the counter door (30) by means of fastening elements with the end purpose of granting better aesthetics to the inner panel (50) by hiding the lower border of the ceramic glass (51) and said lower ratchet (53), preferably in an "L" shape.

Finally, as a separate embodiment, other additional thermal isolating elements may be used such as double-sided tape or any other type of efficient and convenient covering, between the joints of all the different parts which conformed the oven door (1) of the present invention; this with the purpose of avoiding to the maximum degree possible, direct contact between said parts and, as a consequence, to considerably lower the transfer of heat and vibrations between the same.

Alterations to the structure described in the present, shall be foreseen by those persons skilled in the art. However, it should be understood that the present description is related with the preferred embodiments of the invention, which are solely for illustrative purposes, and should not be construed as a limitation of the invention. All modifications which do not depart from the scope of the invention, such as changes to the shape, materials and size dimensions of the pieces, shall be included within the body of the attached claims.

The invention claimed is:

1. A counter door structure for an oven door having an inner or back panoramic glass panel, wherein the counter door structure comprises:

a first section;

a second section; and an isolating thermal seal with a border;

wherein the first section and the second section are coupled to each other;

wherein the isolating thermal seal is interposed between the first section and the second section once the sections are coupled, thus avoiding contact between the sections and creating a thermal barrier between the sections; and wherein the isolating thermal seal has a tubular section along the length of its inner border within which a second seal is introduced to obstruct the isolating thermal seal and to cushion the support of the inner or back glass panel over the counter door, thus avoiding contact between the inner or back glass panel and the counter door.

2. The structure in claim 1, wherein the first section has a structural frame with a substantially square shape and the second section has a structural frame with a substantially square shape.

3. The structure in claim 1, wherein the first section comprises a support groove near an inner perimeter border of said first section and the second section comprises a coupling flange near an outer perimeter border of said second section, wherein, said coupling flange is arranged to coincide within the inner support groove; and wherein said first section contains at least one support or bracket and wherein the second section contains at least one support or bracket, wherein when the first section and the second section are coupled to each other, the support or bracket of the first section is arranged to coincide with the support or bracket of the second section and wherein the supports or brackets are fastened by means of fastening elements.

4. The structure in claim 1, wherein said isolating thermal seal is manufactured with fiber glass thread woven in a substantially plane shape, wherein said isolating thermal seal comprises a seam close to its border and substantially parallel along the entire length of said border, through which the tubular section is formed, and wherein the second seal is cylindrical and made of fiber glass woven in a braided shape.

5. A panoramic oven door of a stove having a counter door structure as recited in claim 1, wherein the panoramic door comprises:

an outer or front panel structure of door formed by a structural support frame, at least one sheet of glass coupled to said structural frame, and isolating elements to prevent contact between the structural support frame and the sheet of glass;

wherein said outer or front panel of door is coupled to the counter door structure.

6. A counter door structure for an oven door having an inner or back panoramic ceramic glass panel, the structure of the counter door comprising:

a first outer section of the counter door shaped as a substantially rectangular structural frame, which has a support groove surrounding an inner perimeter border;

a second inner section of the counter door shaped as a substantially rectangular structural frame, which has a coupling flange surrounding an outer perimeter border;

wherein said first and second sections of the counter door are coupled between each other by a plurality of coinciding supports and brackets formed over the same and joined by fastening elements so that said coupling flange of the second inner section of the counter door is made to coincide within the support groove formed in the first outer section of the counter door;

and wherein an isolating thermal seal made of fiber glass thread woven shaped as a flat hose is interposed between said coupling flange and said support groove to avoid direct contact between both sections of the counter door and creating a thermal barrier between them; said thermal seal having a seam proximate to one of its borders and parallel along the length of the same, and arranged to form a small tubular section along the length of the border of the seal, within which a cylindrical fiber glass seal of a lesser diameter and woven in the shape of a braid is disposed, thus effecting a lateral border which serves as an obstruction element and provides cushioning for support of the ceramic glass panel over the counter door, and without direct contact with the same.

7. The counter door structure for an oven door according to claim 6, wherein the thermal seal has a steel core.

8. The counter door structure for an oven door according to claim 6, wherein the cylindrical fiber glass has a steel core.

9. The counter door structure for an oven door according to claim 6, wherein the inner ceramic panoramic glass panel is coupled to the counter door structure by way of an upper ratchet and a lower ratchet in an "L" shape, fastened onto said counter door by fastening elements.

10. The counter door structure for an oven door according to claim 9, wherein both on the upper border and on the lower border of the inner panel of the panoramic ceramic glass, a silicon seal in a "U" shape is placed, which prevents said ceramic glass being in direct contact with any metallic part, whether said part be the counter door or the upper and lower ratchets.

11. The counter door structure for an oven door according to claim 6, wherein an excess portion of the thermal seal which is not disposed between said first and second sections of the counter door, helps to support over the same the ceramic glass once it is placed over the counter door to avoid direct contact between both thereby reducing heat transfer and cushioning mechanical vibration.

12. The counter door structure for an oven door according to claim 11, wherein between the lower part of the counter door structure and the ceramic glass panel, an isolating supplementary thermal seal is disposed in a longitudinal direction, made in tubular shape with a steel core, through which increased thermal isolation between both parts is accomplished and conducive to cushioning from mechanical impact and/or vibration.

13. The counter door structure for an oven door according to claim 6, wherein at least a couple of hinges are fastened by fastening elements onto said counter door structure.

14. The counter door structure for an oven door according to claim 6, wherein the fastening elements are selected from the group consisting of screws, rivets and bolts.

15. A panoramic oven door of a stove having a counter door structure as recited in claim 6, wherein said panoramic door further comprises:

an outer or front panel door structure formed by a structural support frame, a glass decorative outer sheet coupled to said structural frame by way of flanges and isolating elements to avoid direct contact between both, decorative appliqués coupled onto said structural support frame by fastening elements, and a handle for opening the door fastened to the structural frame;

wherein, said outer or front panel of the door is coupled to the counter door structure by fastening elements and brackets formed on the structural support frame and/or the counter door structure, thus forming the panoramic oven door.

16. The panoramic oven door of a stove according to claim 15, wherein between the outer or front panel of the door and the counter door structure a space is defined and through which cooling air circulates from the at least first opening formed on the lower part of the door to at least a second opening formed on the upper part of the door.

17. The panoramic oven door of a stove according to claim 15, wherein between the outer or front panel of the door and the counter door structure a window package is further coupled, which is formed by two pieces of tinned glass fastened in parallel and spaced apart from one another by a metallic frame surrounding the same so that said package of windows is placed centrally on the inner perimeter border of the second inner section of the counter door and is fastened unto the same.

18. The panoramic oven door of a stove according to claim 17, wherein one or more pieces of thermal insulating material are placed to surround the packet of windows, said pieces fastened by an inner metal guard coupled onto the counter door structure by fastening elements.

19. The panoramic oven door of a stove according to claim 18, wherein the upper part of the metallic inner guard is coupled to an air deflector to deviate and/or stop the cooling air which circulates emanating from the at least one first opening formed on the lower part of the door, to the at least second opening formed on the upper part of the door.

20. The panoramic oven door of a stove according to claim 15, wherein on at least some of the parts of the door one or more sheets of reflecting material are attached to improve thermal isolation.

21. The panoramic oven door of a stove according to claim 15, wherein on at least some of the parts of the door at least one or more masks comprising isolating fiber glass are placed to improve thermal isolation.

22. The panoramic oven door of a stove according to claim 15, wherein the structural support frame is formed from an upper back molding, a lower fastening molding and lateral posts, joined to each other.

* * * * *

UNITED STATES PATENT AND TRADEMARK OFFICE

CERTIFICATE OF CORRECTION

PATENT NO. : 8,839,781 B2
APPLICATION NO. : 13/205896
DATED : September 23, 2014
INVENTOR(S) : Jose Merced Vazquez Garcia et al.

It is certified that error appears in the above-identified patent and that said Letters Patent is hereby corrected as shown below:

In the Claims

Column 10, claim 8, line 49, after "glass" insert --seal--.

Signed and Sealed this
Twenty-seventh Day of January, 2015

Michelle K. Lee

Michelle K. Lee
*Deputy Director of the United States Patent and Trademark Office*